US011483669B2

(12) United States Patent
Ramo et al.

(10) Patent No.: US 11,483,669 B2
(45) Date of Patent: Oct. 25, 2022

(54) SPATIAL AUDIO PARAMETERS

(71) Applicant: Nokia Technologies Oy, Espoo (FI)

(72) Inventors: Anssi Ramo, Tampere (FI); Lasse Laaksonen, Tampere (FI); Henri Toukomaa, Tampere (FI); Antti Eronen, Tampere (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 17/058,713

(22) PCT Filed: May 29, 2019

(86) PCT No.: PCT/FI2019/050414
§ 371 (c)(1),
(2) Date: Nov. 25, 2020

(87) PCT Pub. No.: WO2019/229300
PCT Pub. Date: Dec. 5, 2019

(65) Prior Publication Data

US 2021/0211828 A1 Jul. 8, 2021

(30) Foreign Application Priority Data

May 31, 2018 (GB) ..... 1808897

(51) Int. Cl.
*G10L 19/008* (2013.01)
*H04S 7/00* (2006.01)
*H04S 3/00* (2006.01)

(52) U.S. Cl.
CPC ..... *H04S 7/304* (2013.01); *G10L 19/008* (2013.01); *H04S 3/008* (2013.01); *H04S 2420/01* (2013.01)

(58) Field of Classification Search
CPC ..... H04S 2420/01; H04S 3/008; H04S 7/304; G10L 19/008
USPC ..... 381/303
See application file for complete search history.

(56) References Cited

U.S. PATENT DOCUMENTS

2016/0241981 A1* 8/2016 Law ..... G10L 19/008
2017/0366912 A1 12/2017 Stein et al.

FOREIGN PATENT DOCUMENTS

WO WO 2016/123572 A 8/2016

OTHER PUBLICATIONS

Fraunhofer IIS, Application Bulletin AAC Transport Formats, © 2012 Fraunhofer IIS, 18 pgs.
3rd Generation Partnership Project; Technical Specification Group Services and System Aspects; Virtual Reality (VR) media services over 3GPP (Release 15), 3GPP TR 26.918 V15.2.0, Mar. 2018, 119 pages.

* cited by examiner

*Primary Examiner* — Paul Kim
(74) *Attorney, Agent, or Firm* — Harrington & Smith

(57) ABSTRACT

An apparatus including circuitry configured for: defining at least one parameter field associated with an input multi-channel audio signals, the at least one parameter field configured to describe at least one characteristic of the multi-channel audio signals; determining at least one spatial audio parameter associated with the multi-channel audio signals; and controlling a rendering of the multi-channel audio signals by processing the input multichannel audio signals using at least the at least one characteristic of the multi-channel audio signals and the at least one spatial audio parameter.

21 Claims, 12 Drawing Sheets

SPATIAL AUDIO PARAMETERS

CROSS REFERENCE TO RELATED APPLICATION

This patent application is a U.S. National Stage application of International Patent Application Number PCT/FI2019/050414 filed May 29, 2019, which is hereby incorporated by reference in its entirety, and claims priority to GB 1808897.1 filed May 31, 2018.

FIELD

The present application relates to apparatus and methods for sound-field related parameter estimation in frequency bands, but not exclusively for time-frequency domain sound-field related parameter estimation for an audio encoder and decoder.

BACKGROUND

Parametric spatial audio processing is a field of audio signal processing where the spatial aspect of the sound is described using a set of parameters. For example, in parametric spatial audio capture from microphone arrays, it is a typical and an effective choice to estimate from the microphone array signals a set of parameters such as directions of the sound in frequency bands, and the ratios between the directional and non-directional parts of the captured sound in frequency bands. These parameters are known to well describe the perceptual spatial properties of the captured sound at the position of the microphone array. These parameters can be utilized in synthesis of the spatial sound accordingly, for headphones binaurally, for loudspeakers, or to other formats, such as Ambisonics.

The directions and direct-to-total energy ratios in frequency bands are thus a parameterization that is particularly effective for spatial audio capture.

SUMMARY

There is provided according to a first aspect an apparatus comprising means for: defining at least one parameter field associated with an input multi-channel audio signals, the at least one parameter field configured to describe at least one characteristic of the multi-channel audio signals; determining at least one spatial audio parameter associated with the multi-channel audio signals; and controlling a rendering of the multi-channel audio signals by processing the input multichannel audio signals using at least the at least one characteristic of the multi-channel audio signals and the at least one spatial audio parameter.

The means for defining at least one parameter field associated with the multi-channel audio signals, the at least one parameter field configured to describe a characteristic of the multi-channel audio signals may comprise at least one first field configured to identify the multi-channel audio signals as a specific type of audio signal.

The specific type of audio signals may comprise at least one of: microphone captured multi-channel audio signals; binaural audio signals; signal processed audio signals; enhanced signal processed audio signals; noise suppressed signal processed audio signals; source separated signal processed audio signals; tracked source signal processed audio signals; spatial processed audio signals; advanced signal processed audio signals; and ambisonics audio signals.

The means for defining at least one parameter field associated with the multi-channel audio signals, the at least one parameter field configured to describe a characteristic of the multi-channel audio signals may comprise at least one second field configured to identify a characteristic associated with the specific type of audio signal.

The characteristic associated with the specific type of audio signal when the specific type of audio signals is microphone captured multi-channel audio signals may comprise one of: identifying a microphone profile for at least one microphone of a microphone array caused to capture the microphone captured multi-channel audio signals; identifying a configuration of the microphone array caused to capture the microphone captured multi-channel audio signals; and identifying a location and/or arrangement of at least two microphones within the microphone array caused to capture the microphone captured multi-channel audio signals.

The microphone profile for at least one microphone caused to capture the microphone captured multi-channel audio signals may comprise at least one of: a omnidirectional microphone profile; a subcardoid directional microphone profile; a cardoid directional microphone profile; a hypercardoid directional microphone profile; a supercardoid directional microphone profile; a shotgun directional microphone profile; a figure-8/midside directional microphone profile; and a boundary directional microphone profile.

The means for defining at least one parameter field associated with the multi-channel audio signals, the at least one parameter field configured to describe a characteristic of the multi-channel audio signals may comprise at least one third field configured to identify a characteristic associated with the specific microphone profile.

The characteristic associated with the specific microphone profile may comprise at least one of: a distance between at least two microphones of the microphone array; and a direction of the at least one microphone of the microphone array.

The characteristic associated with the specific type of audio signal when the specific type of audio signals is binaural audio signals may comprise identifying a head related transfer function.

The means for defining at least one parameter field associated with the multi-channel audio signals, the at least one parameter field configured to describe a characteristic of the multi-channel audio signals may comprise at least one third field configured to identify a direction associated with the head related transfer function.

The characteristic associated with the specific type of audio signal when the specific type of audio signals is spatial processed audio signals may comprise identifying a parameter identifying a processing variant to assist the rendering.

The parameter identifying a processing variant to assist the rendering may comprise at least one of: a beamforming applied to at least two captured audio signals to form the multi-channel audio signals; a processing variant applied to at least two captured audio signals to form the multi-channel audio signals; an indicator identifying possible audio rendering signal processing variants available to be selected from by the decoder; a left-right side focus; a front-back focus; a noise suppressed-residual noise signal; a target tracking-remainder signal; a main-residual signal; a source 1-source 2 signal; and a beam 1-beam 2 signal.

The means for defining at least one parameter field associated with the multi-channel audio signals, the at least one parameter field configured to describe a characteristic of the multi-channel audio signals may comprise at least one third field configured to identify a focus amount associated with the processing variant.

The characteristic associated with the specific type of audio signal when the specific type of audio signals is ambisonics audio signals may comprise identifying a format of the ambisonics audio signals.

The parameter identifying a format of the ambisonics audio signals may comprise at least one of: a A-format identifier; a B-format identifier; a four quadrants identifier; and a head transfer function identifier.

The means for defining at least one parameter field associated with the multi-channel audio signals, the at least one parameter field configured to describe a characteristic of the multi-channel audio signals may comprise at least one third field configured to identify a normalisation associated with the ambisonics audio signal, wherein the normalisation comprised at least one of: B-format normalisation; SN3D normalisation; SN2D normalisation; maxN normalisation; N3D normalisation; and N2D/SN2D normalisation.

The means may be further for transmitting the at least one parameter field associated with an input multi-channel audio signals to a renderer for rendering of the multi-channel audio signals.

The means may be further for receiving a user input, wherein the means for defining at least one parameter field associated with an input multi-channel audio signals may be based on the user input.

The means for defining at least one parameter field associated with an input multi-channel audio signals may be based on the user input is further for defining the at least one parameter field as a determined default value in the absence of a user input.

The at least one spatial audio parameter may comprise directions and energy ratios for at least two frequency bands of the multi-channel audio signals.

According to a second aspect there is provided an apparatus comprising means for: receiving at least one parameter field associated with multi-channel audio signals, the at least one parameter field configured to describe a characteristic of the multi-channel audio signals; receiving at least one spatial audio parameter; determining the multi-channel audio signals; and processing the multi-channel audio signals based on the at least one spatial audio parameter and at least one parameter field associated with the multi-channel audio signals to assist a rendering of the multi-channel audio signals.

The at least one parameter field associated with the multi-channel audio signals may comprise at least one first field configured to identify the multi-channel audio signals as a specific type of audio signal.

The specific type of audio signals may comprise at least one of: microphone captured multi-channel audio signals; binaural audio signals; signal processed audio signals; enhanced signal processed audio signals; noise suppressed signal processed audio signals; source separated signal processed audio signals; tracked source signal processed audio signals; advanced signal processed audio signals;

spatial processed audio signals; and ambisonics audio signals.

The at least one parameter field associated with the multi-channel audio signals may comprise at least one second field configured to identify a characteristic associated with the specific type of audio signal.

The characteristic associated with the specific type of audio signal when the specific type of audio signals is microphone captured multi-channel audio signals may comprise one of:

identifying a microphone profile for at least one microphone of a microphone array caused to capture the microphone captured multi-channel audio signals;

identifying a configuration of the microphone array caused to capture the microphone captured multi-channel audio signals; and identifying a location and/or arrangement of at least two microphones within the microphone array caused to capture the microphone captured multi-channel audio signals.

The microphone profile for at least one microphone caused to capture the microphone captured multi-channel audio signals may comprise at least one of: a omnidirectional microphone profile; a subcardoid directional microphone profile; a cardoid directional microphone profile; a hypercardoid directional microphone profile; a supercardoid directional microphone profile; a shotgun directional microphone profile; a figure-8/midside directional microphone profile; and a boundary directional microphone profile.

The at least one parameter field associated with the multi-channel audio signals may comprise at least one third field configured to identify a characteristic associated with the specific microphone profile.

The characteristic associated with the specific microphone profile may comprise at least one of: a distance between at least two microphones of the microphone array; and a direction of the at least one microphone of the microphone array.

The characteristic associated with the specific type of audio signal when the specific type of audio signals is binaural audio signals may comprise identifying a head related transfer function.

The at least one parameter field associated with the multi-channel audio signals may comprise at least one third field configured to identify a direction associated with the head related transfer function.

The characteristic associated with the specific type of audio signal when the specific type of audio signals is spatial processed audio signals may comprise a parameter identifying a processing variant to assist the rendering.

The parameter identifying a processing variant to assist the rendering may comprise at least one of: a beamforming applied to at least two captured audio signals to form the multi-channel audio signals; a processing variant applied to at least two captured audio signals to form the multi-channel audio signals; an indicator identifying an audio rendering signal processing variants available to be selected from by the apparatus; a left-right side focus; a front-back focus; a noise suppressed-residual noise signal; a target tracking-remainder signal; a main-residual signal; a source 1-source 2 signal; and a beam 1-beam 2 signal.

The at least one parameter field associated with the multi-channel audio signals may comprise at least one third field configured to identify a focus amount associated with the processing variant.

The characteristic associated with the specific type of audio signal when the specific type of audio signals is ambisonics audio signals may comprise a format of the ambisonics audio signals.

The parameter field identifying a format of the ambisonics audio signals may comprise at least one of: a A-format identifier; a B-format identifier; a four quadrants identifier; and a head transfer function identifier.

The at least one parameter field may comprise at least one third field configured to identify a normalisation associated with the ambisonics audio signal, wherein the normalisation may comprise at least one of: B-format normalisation; SN3D normalisation; SN2D normalisation; maxN normalisation; N3D normalisation; and N2D/SN2D normalisation.

The means may be further for receiving a user input, wherein the means for processing the multi-channel audio signals based on the at least one spatial audio parameter and at least one parameter field associated with the multi-channel audio signals to assist a rendering of the multi-channel audio signals may be further based on the user input.

The means for processing the multi-channel audio signals based on the at least one spatial audio parameter and at least one parameter field associated with the multi-channel audio signals to assist a rendering of the multi-channel audio signals may be further for defining the at least one parameter field as a determined default value in the absence of a user input.

According to a third aspect there is provided an apparatus comprising at least one processor and at least one memory including a computer program code, the at least one memory and the computer program code configured to, with the at least one processor, cause the apparatus at least to: define at least one parameter field associated with an input multi-channel audio signals, the at least one parameter field configured to describe at least one characteristic of the multi-channel audio signals; determine at least one spatial audio parameter associated with the multi-channel audio signals; and control a rendering of the multi-channel audio signals by processing the input multichannel audio signals using at least the at least one characteristic of the multi-channel audio signals and the at least one spatial audio parameter.

The apparatus caused to define at least one parameter field associated with the multi-channel audio signals, the at least one parameter field configured to describe a characteristic of the multi-channel audio signals may comprise at least one first field configured to identify the multi-channel audio signals as a specific type of audio signal.

The specific type of audio signals may comprise at least one of: microphone captured multi-channel audio signals; binaural audio signals; signal processed audio signals; enhanced signal processed audio signals; noise suppressed signal processed audio signals; source separated signal processed audio signals; tracked source signal processed audio signals; spatial processed audio signals; advanced signal processed audio signals; and ambisonics audio signals.

The apparatus caused to define at least one parameter field associated with the multi-channel audio signals, the at least one parameter field configured to describe a characteristic of the multi-channel audio signals may comprise at least one second field configured to identify a characteristic associated with the specific type of audio signal.

The characteristic associated with the specific type of audio signal when the specific type of audio signals is microphone captured multi-channel audio signals may comprise one of: identifying a microphone profile for at least one microphone of a microphone array caused to capture the microphone captured multi-channel audio signals; identifying a configuration of the microphone array caused to capture the microphone captured multi-channel audio signals; and identifying a location and/or arrangement of at least two microphones within the microphone array caused to capture the microphone captured multi-channel audio signals.

The microphone profile for at least one microphone caused to capture the microphone captured multi-channel audio signals may comprise at least one of: a omnidirectional microphone profile; a subcardoid directional microphone profile; a cardoid directional microphone profile; a hypercardoid directional microphone profile; a supercardoid directional microphone profile; a shotgun directional microphone profile; a figure-8/midside directional microphone profile; and a boundary directional microphone profile.

The apparatus caused to define at least one parameter field associated with the multi-channel audio signals, the at least one parameter field configured to describe a characteristic of the multi-channel audio signals may comprise at least one third field configured to identify a characteristic associated with the specific microphone profile.

The characteristic associated with the specific microphone profile may comprise at least one of: a distance between at least two microphones of the microphone array; and a direction of the at least one microphone of the microphone array.

The characteristic associated with the specific type of audio signal when the specific type of audio signals is binaural audio signals may comprise identifying a head related transfer function.

The apparatus caused to define at least one parameter field associated with the multi-channel audio signals, the at least one parameter field configured to describe a characteristic of the multi-channel audio signals may comprise at least one third field configured to identify a direction associated with the head related transfer function.

The characteristic associated with the specific type of audio signal when the specific type of audio signals is spatial processed audio signals may comprise identifying a parameter identifying a processing variant to assist the rendering.

The parameter identifying a processing variant to assist the rendering may comprise at least one of: a beamforming applied to at least two captured audio signals to form the multi-channel audio signals; a processing variant applied to at least two captured audio signals to form the multi-channel audio signals; an indicator identifying possible audio rendering signal processing variants available to be selected from by the decoder; a left-right side focus; a front-back focus; a noise suppressed-residual noise signal; a target tracking-remainder signal; a main-residual signal; a source 1-source 2 signal; and a beam 1-beam 2 signal.

The apparatus caused to define at least one parameter field associated with the multi-channel audio signals, the at least one parameter field configured to describe a characteristic of the multi-channel audio signals may comprise at least one third field configured to identify a focus amount associated with the processing variant.

The characteristic associated with the specific type of audio signal when the specific type of audio signals is ambisonics audio signals may comprise identifying a format of the ambisonics audio signals.

The parameter identifying a format of the ambisonics audio signals may comprise at least one of: a A-format identifier; a B-format identifier; a four quadrants identifier; and a head transfer function identifier.

The apparatus caused to define at least one parameter field associated with the multi-channel audio signals, the at least one parameter field configured to describe a characteristic of the multi-channel audio signals may comprise at least one third field configured to identify a normalisation associated with the ambisonics audio signal, wherein the normalisation comprised at least one of: B-format normalisation; SN3D normalisation; SN2D normalisation; maxN normalisation; N3D normalisation; and N2D/SN2D normalisation.

The apparatus may be further caused to transmit the at least one parameter field associated with an input multi-channel audio signals to a renderer for rendering of the multi-channel audio signals.

The apparatus may be further caused to receive a user input, wherein the apparatus caused to define at least one parameter field associated with an input multi-channel audio signals may be based on the user input.

The apparatus caused to define at least one parameter field associated with an input multi-channel audio signals may be based on the user input is further for defining the at least one parameter field as a determined default value in the absence of a user input.

The at least one spatial audio parameter may comprise directions and energy ratios for at least two frequency bands of the multi-channel audio signals.

According to a fourth aspect there is provided an apparatus comprising at least one processor and at least one memory including a computer program code, the at least one memory and the computer program code configured to, with the at least one processor, cause the apparatus at least to: receive at least one parameter field associated with multi-channel audio signals, the at least one parameter field configured to describe a characteristic of the multi-channel audio signals; receive at least one spatial audio parameter; determine the multi-channel audio signals; and process the multi-channel audio signals based on the at least one spatial audio parameter and at least one parameter field associated with the multi-channel audio signals to assist a render of the multi-channel audio signals.

The at least one parameter field associated with the multi-channel audio signals may comprise at least one first field configured to identify the multi-channel audio signals as a specific type of audio signal.

The specific type of audio signals may comprise at least one of: microphone captured multi-channel audio signals; binaural audio signals; signal processed audio signals; enhanced signal processed audio signals; noise suppressed signal processed audio signals; source separated signal processed audio signals; tracked source signal processed audio signals; advanced signal processed audio signals; spatial processed audio signals; and ambisonics audio signals.

The at least one parameter field associated with the multi-channel audio signals may comprise at least one second field configured to identify a characteristic associated with the specific type of audio signal.

The characteristic associated with the specific type of audio signal when the specific type of audio signals is microphone captured multi-channel audio signals may comprise one of: identifying a microphone profile for at least one microphone of a microphone array caused to capture the microphone captured multi-channel audio signals; identifying a configuration of the microphone array caused to capture the microphone captured multi-channel audio signals; and identifying a location and/or arrangement of at least two microphones within the microphone array caused to capture the microphone captured multi-channel audio signals.

The microphone profile for at least one microphone caused to capture the microphone captured multi-channel audio signals may comprise at least one of: a omnidirectional microphone profile; a subcardoid directional microphone profile; a cardoid directional microphone profile; a hypercardoid directional microphone profile; a supercardoid directional microphone profile; a shotgun directional microphone profile; a figure-8/midside directional microphone profile; and a boundary directional microphone profile.

The at least one parameter field associated with the multi-channel audio signals may comprise at least one third field configured to identify a characteristic associated with the specific microphone profile.

The characteristic associated with the specific microphone profile may comprise at least one of: a distance between at least two microphones of the microphone array; and a direction of the at least one microphone of the microphone array.

The characteristic associated with the specific type of audio signal when the specific type of audio signals is binaural audio signals may comprise identifying a head related transfer function.

The at least one parameter field associated with the multi-channel audio signals may comprise at least one third field configured to identify a direction associated with the head related transfer function.

The characteristic associated with the specific type of audio signal when the specific type of audio signals is spatial processed audio signals may comprise a parameter identifying a processing variant to assist the rendering.

The parameter identifying a processing variant to assist the rendering may comprise at least one of: a beamforming applied to at least two captured audio signals to form the multi-channel audio signals; a processing variant applied to at least two captured audio signals to form the multi-channel audio signals; an indicator identifying an audio rendering signal processing variants available to be selected from by the apparatus; a left-right side focus; a front-back focus; a noise suppressed-residual noise signal; a target tracking-remainder signal; a main-residual signal; a source 1-source 2 signal; and a beam 1-beam 2 signal.

The at least one parameter field associated with the multi-channel audio signals may comprise at least one third field configured to identify a focus amount associated with the processing variant.

The characteristic associated with the specific type of audio signal when the specific type of audio signals is ambisonics audio signals may comprise a format of the ambisonics audio signals.

The parameter field identifying a format of the ambisonics audio signals may comprise at least one of: a A-format identifier; a B-format identifier; a four quadrants identifier; and a head transfer function identifier.

The at least one parameter field may comprise at least one third field configured to identify a normalisation associated with the ambisonics audio signal, wherein the normalisation may comprise at least one of: B-format normalisation; SN3D normalisation; SN2D normalisation; maxN normalisation; N3D normalisation; and N2D/SN2D normalisation.

The apparatus may be further caused to receive a user input, wherein the apparatus caused to process the multi-channel audio signals based on the at least one spatial audio parameter and at least one parameter field associated with the multi-channel audio signals to assist a render of the multi-channel audio signals may be further based on the user input.

The apparatus caused to process the multi-channel audio signals based on the at least one spatial audio parameter and at least one parameter field associated with the multi-channel audio signals to assist a render of the multi-channel audio signals may be further caused to define the at least one parameter field as a determined default value in the absence of a user input.

According to a fifth aspect there is provided a method comprising: defining at least one parameter field associated with an input multi-channel audio signals, the at least one parameter field configured to describe at least one characteristic of the multi-channel audio signals; determining at least one spatial audio parameter associated with the multi-channel audio signals; and controlling a rendering of the multi-channel audio signals by processing the input multi-channel audio signals using at least the at least one characteristic of the multi-channel audio signals and the at least one spatial audio parameter.

Defining at least one parameter field associated with the multi-channel audio signals, the at least one parameter field configured to describe a characteristic of the multi-channel audio signals may comprise at least one first field configured to identify the multi-channel audio signals as a specific type of audio signal.

The specific type of audio signals may comprise at least one of: microphone captured multi-channel audio signals; binaural audio signals; signal processed audio signals; enhanced signal processed audio signals; noise suppressed signal processed audio signals; source separated signal processed audio signals; tracked source signal processed audio signals; spatial processed audio signals; advanced signal processed audio signals; and ambisonics audio signals.

Defining at least one parameter field associated with the multi-channel audio signals, the at least one parameter field configured to describe a characteristic of the multi-channel audio signals may comprise at least one second field configured to identify a characteristic associated with the specific type of audio signal.

The characteristic associated with the specific type of audio signal when the specific type of audio signals is microphone captured multi-channel audio signals may comprise one of: identifying a microphone profile for at least one microphone of a microphone array caused to capture the microphone captured multi-channel audio signals; identifying a configuration of the microphone array caused to capture the microphone captured multi-channel audio signals; and identifying a location and/or arrangement of at least two microphones within the microphone array caused to capture the microphone captured multi-channel audio signals.

The microphone profile for at least one microphone caused to capture the microphone captured multi-channel audio signals may comprise at least one of: a omnidirectional microphone profile; a subcardoid directional microphone profile; a cardoid directional microphone profile; a hypercardoid directional microphone profile; a supercardoid directional microphone profile; a shotgun directional microphone profile; a figure-8/midside directional microphone profile; and a boundary directional microphone profile.

Defining at least one parameter field associated with the multi-channel audio signals, the at least one parameter field configured to describe a characteristic of the multi-channel audio signals may comprise at least one third field configured to identify a characteristic associated with the specific microphone profile.

The characteristic associated with the specific microphone profile may comprise at least one of: a distance between at least two microphones of the microphone array; and a direction of the at least one microphone of the microphone array.

The characteristic associated with the specific type of audio signal when the specific type of audio signals is binaural audio signals may comprise identifying a head related transfer function.

Defining at least one parameter field associated with the multi-channel audio signals, the at least one parameter field configured to describe a characteristic of the multi-channel audio signals may comprise at least one third field configured to identify a direction associated with the head related transfer function.

The characteristic associated with the specific type of audio signal when the specific type of audio signals is spatial processed audio signals may comprise identifying a parameter identifying a processing variant to assist the rendering.

The parameter identifying a processing variant to assist the rendering may comprise at least one of: a beamforming applied to at least two captured audio signals to form the multi-channel audio signals; a processing variant applied to at least two captured audio signals to form the multi-channel audio signals; an indicator identifying possible audio rendering signal processing variants available to be selected from by the decoder; a left-right side focus; a front-back focus; a noise suppressed-residual noise signal; a target tracking-remainder signal; a main-residual signal; a source 1-source 2 signal; and a beam 1-beam 2 signal.

Defining at least one parameter field associated with the multi-channel audio signals, the at least one parameter field configured to describe a characteristic of the multi-channel audio signals may comprise at least one third field configured to identify a focus amount associated with the processing variant.

The characteristic associated with the specific type of audio signal when the specific type of audio signals is ambisonics audio signals may comprise identifying a format of the ambisonics audio signals.

The parameter identifying a format of the ambisonics audio signals may comprise at least one of: a A-format identifier; a B-format identifier; a four quadrants identifier; and a head transfer function identifier.

Defining at least one parameter field associated with the multi-channel audio signals, the at least one parameter field configured to describe a characteristic of the multi-channel audio signals may comprise at least one third field configured to identify a normalisation associated with the ambisonics audio signal, wherein the normalisation comprised at least one of: B-format normalisation; SN3D normalisation; SN2D normalisation; maxN normalisation; N3D normalisation; and N2D/SN2D normalisation.

The method may further comprise transmitting the at least one parameter field associated with an input multi-channel audio signals to a renderer for rendering of the multi-channel audio signals.

The method may further comprise receiving a user input, wherein defining at least one parameter field associated with an input multi-channel audio signals may be based on the user input.

Defining at least one parameter field associated with an input multi-channel audio signals may be based on the user input is further for defining the at least one parameter field as a determined default value in the absence of a user input.

The at least one spatial audio parameter may comprise directions and energy ratios for at least two frequency bands of the multi-channel audio signals.

According to a sixth aspect there is provided an method comprising: receiving at least one parameter field associated with multi-channel audio signals, the at least one parameter field configured to describe a characteristic of the multi-channel audio signals; receiving at least one spatial audio parameter; determining the multi-channel audio signals; and processing the multi-channel audio signals based on the at least one spatial audio parameter and at least one parameter field associated with the multi-channel audio signals to assist a rendering of the multi-channel audio signals.

The at least one parameter field associated with the multi-channel audio signals may comprise at least one first field configured to identify the multi-channel audio signals as a specific type of audio signal.

The specific type of audio signals may comprise at least one of: microphone captured multi-channel audio signals; binaural audio signals; signal processed audio signals; enhanced signal processed audio signals; noise suppressed signal processed audio signals; source separated signal processed audio signals; tracked source signal processed audio signals; advanced signal processed audio signals; spatial processed audio signals; and ambisonics audio signals.

The at least one parameter field associated with the multi-channel audio signals may comprise at least one second field configured to identify a characteristic associated with the specific type of audio signal.

The characteristic associated with the specific type of audio signal when the specific type of audio signals is microphone captured multi-channel audio signals may comprise one of: identifying a microphone profile for at least one microphone of a microphone array caused to capture the microphone captured multi-channel audio signals; identifying a configuration of the microphone array caused to capture the microphone captured multi-channel audio signals; and identifying a location and/or arrangement of at least two microphones within the microphone array caused to capture the microphone captured multi-channel audio signals.

The microphone profile for at least one microphone caused to capture the microphone captured multi-channel audio signals may comprise at least one of: a omnidirectional microphone profile; a subcardoid directional microphone profile; a cardoid directional microphone profile; a hypercardoid directional microphone profile; a supercardoid directional microphone profile; a shotgun directional microphone profile; a figure-8/midside directional microphone profile; and a boundary directional microphone profile.

The at least one parameter field associated with the multi-channel audio signals may comprise at least one third field configured to identify a characteristic associated with the specific microphone profile.

The characteristic associated with the specific microphone profile may comprise at least one of: a distance between at least two microphones of the microphone array; and a direction of the at least one microphone of the microphone array.

The characteristic associated with the specific type of audio signal when the specific type of audio signals is binaural audio signals may comprise identifying a head related transfer function.

The at least one parameter field associated with the multi-channel audio signals may comprise at least one third field configured to identify a direction associated with the head related transfer function.

The characteristic associated with the specific type of audio signal when the specific type of audio signals is spatial processed audio signals may comprise a parameter identifying a processing variant to assist the rendering.

The parameter identifying a processing variant to assist the rendering may comprise at least one of: a beamforming applied to at least two captured audio signals to form the multi-channel audio signals; a processing variant applied to at least two captured audio signals to form the multi-channel audio signals; an indicator identifying an audio rendering signal processing variants available to be selected from by the apparatus; a left-right side focus; a front-back focus; a noise suppressed-residual noise signal; a target tracking-remainder signal; a main-residual signal; a source 1-source 2 signal; and a beam 1-beam 2 signal.

The at least one parameter field associated with the multi-channel audio signals may comprise at least one third field configured to identify a focus amount associated with the processing variant.

The characteristic associated with the specific type of audio signal when the specific type of audio signals is ambisonics audio signals may comprise a format of the ambisonics audio signals.

The parameter field identifying a format of the ambisonics audio signals may comprise at least one of: a A-format identifier; a B-format identifier; a four quadrants identifier; and a head transfer function identifier.

The at least one parameter field may comprise at least one third field configured to identify a normalisation associated with the ambisonics audio signal, wherein the normalisation may comprise at least one of: B-format normalisation; SN3D normalisation; SN2D normalisation; maxN normalisation; N3D normalisation; and N2D/SN2D normalisation.

The method may further comprise receiving a user input, wherein processing the multi-channel audio signals based on the at least one spatial audio parameter and at least one parameter field associated with the multi-channel audio signals to assist a rendering of the multi-channel audio signals may further be based on the user input.

Processing the multi-channel audio signals based on the at least one spatial audio parameter and at least one parameter field associated with the multi-channel audio signals to assist a rendering of the multi-channel audio signals may further be for defining the at least one parameter field as a determined default value in the absence of a user input.

According to a seventh aspect there is provided a computer program comprising instructions [or a computer readable medium comprising program instructions] for causing an apparatus to perform at least the following: defining at least one parameter field associated with an input multi-channel audio signals, the at least one parameter field configured to describe at least one characteristic of the multi-channel audio signals; determining at least one spatial audio parameter associated with the multi-channel audio signals; and controlling a rendering of the multi-channel audio signals by processing the input multichannel audio signals using at least the at least one characteristic of the multi-channel audio signals and the at least one spatial audio parameter.

According to an eighth aspect there is provided a computer program comprising instructions [or a computer readable medium comprising program instructions] for causing an apparatus to perform at least the following: receiving at least one parameter field associated with multi-channel audio signals, the at least one parameter field configured to describe a characteristic of the multi-channel audio signals; receiving at least one spatial audio parameter; determining the multi-channel audio signals; and processing the multi-channel audio signals based on the at least one spatial audio parameter and at least one parameter field associated with the multi-channel audio signals to assist a rendering of the multi-channel audio signals.

According to a ninth aspect there is provided a non-transitory computer readable medium comprising program instructions for causing an apparatus to perform at least the following: defining at least one parameter field associated with an input multi-channel audio signals, the at least one parameter field configured to describe at least one characteristic of the multi-channel audio signals; determining at least one spatial audio parameter associated with the multi-channel audio signals; and controlling a rendering of the multi-channel audio signals by processing the input multi-channel audio signals using at least the at least one characteristic of the multi-channel audio signals and the at least one spatial audio parameter.

According to a tenth aspect there is provided a non-transitory computer readable medium comprising program instructions for causing an apparatus to perform at least the following: receiving at least one parameter field associated with multi-channel audio signals, the at least one parameter field configured to describe a characteristic of the multi-channel audio signals; receiving at least one spatial audio parameter; determining the multi-channel audio signals; and processing the multi-channel audio signals based on the at least one spatial audio parameter and at least one parameter field associated with the multi-channel audio signals to assist a rendering of the multi-channel audio signals.

According to an eleventh aspect there is provided an apparatus comprising: defining circuitry configured to define at least one parameter field associated with an input multi-channel audio signals, the at least one parameter field configured to describe at least one characteristic of the multi-channel audio signals; determining circuitry configured to determine at least one spatial audio parameter associated with the multi-channel audio signals; and controlling circuitry configured to control a rendering of the multi-channel audio signals by processing the input multi-channel audio signals using at least the at least one characteristic of the multi-channel audio signals and the at least one spatial audio parameter.

According to a twelfth aspect there is provided an apparatus comprising: receiving circuitry configured to receive at least one parameter field associated with multi-channel audio signals, the at least one parameter field configured to describe a characteristic of the multi-channel audio signals; receiving circuitry configured to receive at least one spatial audio parameter; determining circuitry configured to determine the multi-channel audio signals; and processing circuitry configured to process the multi-channel audio signals based on the at least one spatial audio parameter and at least one parameter field associated with the multi-channel audio signals to assist a rendering of the multi-channel audio signals.

According to a thirteenth aspect there is provided a computer readable medium comprising program instructions for causing an apparatus to perform at least the following: defining at least one parameter field associated with an input multi-channel audio signals, the at least one parameter field configured to describe at least one characteristic of the multi-channel audio signals; determining at least one spatial audio parameter associated with the multi-channel audio signals; and controlling a rendering of the multi-channel audio signals by processing the input multichannel audio signals using at least the at least one characteristic of the multi-channel audio signals and the at least one spatial audio parameter.

According to a fourteenth aspect there is provided a computer readable medium comprising program instructions for causing an apparatus to perform at least the following: receiving at least one parameter field associated with multi-channel audio signals, the at least one parameter field configured to describe a characteristic of the multi-channel audio signals; receiving at least one spatial audio parameter; determining the multi-channel audio signals; and processing the multi-channel audio signals based on the at least one spatial audio parameter and at least one parameter field associated with the multi-channel audio signals to assist a rendering of the multi-channel audio signals.

An apparatus comprising means for performing the actions of the method as described above.

An apparatus configured to perform the actions of the method as described above.

A computer program comprising program instructions for causing a computer to perform the method as described above.

A computer program product stored on a medium may cause an apparatus to perform the method as described herein.

An electronic device may comprise apparatus as described herein.

A chipset may comprise apparatus as described herein.

Embodiments of the present application aim to address problems associated with the state of the art.

SUMMARY OF THE FIGURES

For a better understanding of the present application, reference will now be made by way of example to the accompanying drawings in which.

EMBODIMENTS OF THE APPLICATION

The following describes in further detail suitable apparatus and possible mechanisms for the provision of effective spatial analysis derived metadata parameters for microphone array input format audio signals.

The concepts as expressed in the embodiments hereafter is the implementation of suitable parameters in assisting in describing a spatial metadata defined audio system.

Figure 1:
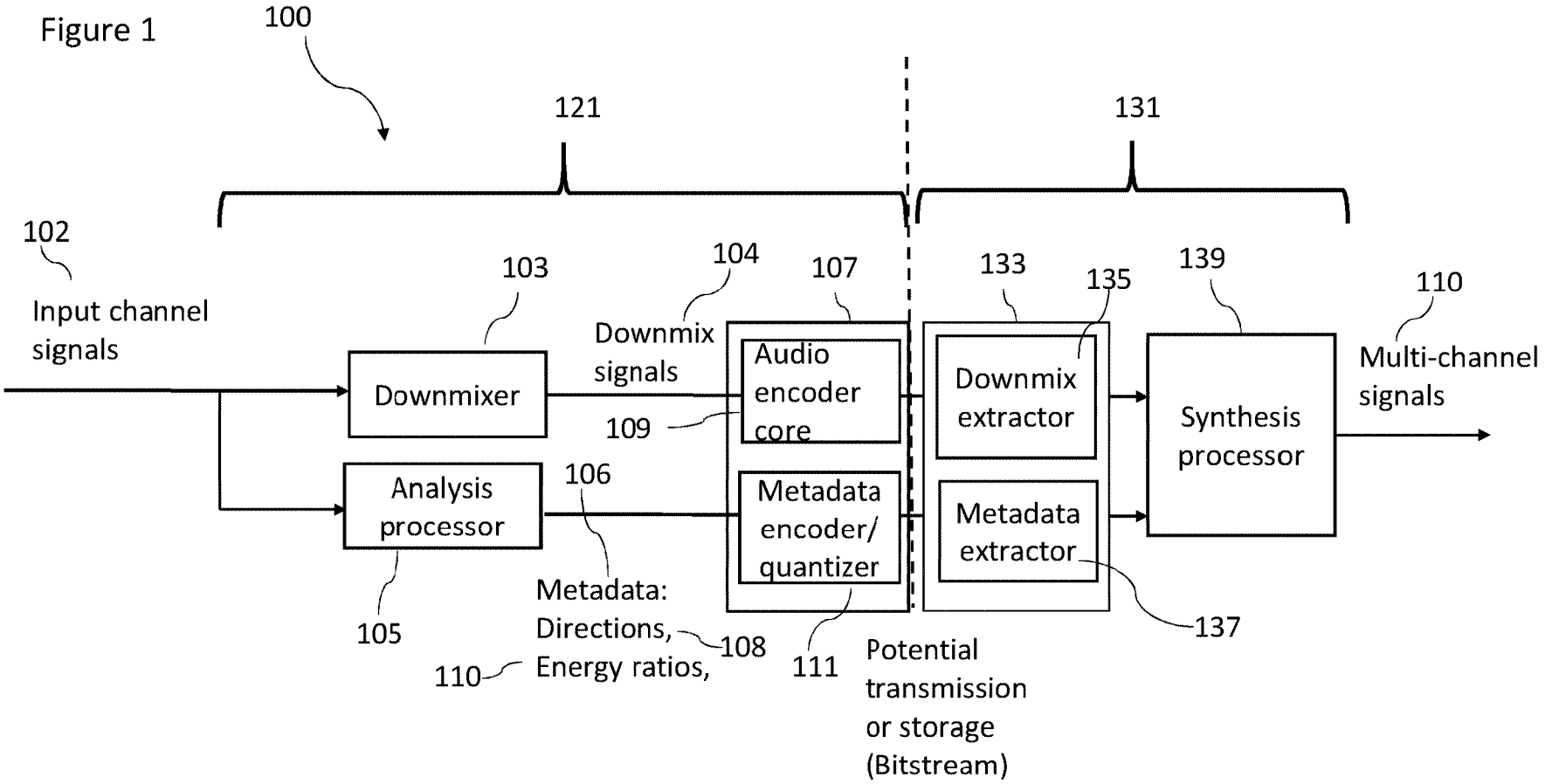
FIG. 1 shows schematically a system of apparatus suitable for implementing some embodiments.

With respect to FIG. 1 an example apparatus and system for implementing embodiments of the application are shown. The system 100 is shown with an 'analysis' part 121 and a 'synthesis' part 131. The 'analysis' part 121 is the part from receiving the microphone array audio signals up to an encoding of the metadata and transport signal and the 'synthesis' part 131 is the part from a decoding of the encoded metadata and transport signal to the presentation of the re-generated signal (for example in multi-channel loudspeaker form).

The input to the system 100 and the 'analysis' part 121 is input channel audio signals 102. These may be any suitable input multichannel audio signals such as microphone array audio signals, ambisonic audio signals, spatial multichannel audio signals. In the following examples the input is generated by a suitable microphone array but it is understood that other multichannel input audio formats may be employed in a similar fashion in some further embodiments. The microphone array audio signals may be obtained from any suitable capture device and may be local or remote from the example apparatus, or virtual microphone recordings obtained from for example loudspeaker signals. For example in some embodiments the analysis part 121 is integrated on a suitable capture device.

The microphone array audio signals are passed to a transport signal generator 103 and to an analysis processor 105.

In some embodiments the transport signal generator 103 is configured to receive the microphone array audio signals and generate suitable transport signals 104. The transport audio signals may also be known as associated audio signals and be based on the spatial audio signals which contains directional information of a sound field and which is input to the system. For example in some embodiments the transport signal generator 103 is configured to downmix or otherwise select or combine, for example, by beamforming techniques the microphone array audio signals to a determined number of channels and output these as transport signals 104. The transport signal generator 103 may be configured to generate a 2 audio channel output of the microphone array audio signals. The determined number of channels may be two or any suitable number of channels. In some embodiments the transport signal generator 103 is optional and the microphone array audio signals are passed unprocessed to an encoder in the same manner as the transport signals. In some embodiments the transport signal generator 103 is configured to select one or more of the microphone audio signals and output the selection as the transport signals 104. In some embodiments the transport signal generator 103 is configured to apply any suitable encoding or quantization to the microphone array audio signals or processed or selected form of the microphone array audio signals.

In some embodiments the analysis processor 105 is also configured to receive the microphone array audio signals and analyse the signals to produce metadata 106 associated with the microphone array audio signals and thus associated with the transport signals 104. The analysis processor 105 can, for example, be a computer (running suitable software stored on memory and on at least one processor), or alternatively a specific device utilizing, for example, FPGAs or ASICs. As shown herein in further detail the metadata may comprise, for each time-frequency analysis interval, a direction parameter 108, an energy ratio parameter 110, a surrounding coherence parameter 112, and a spread coherence parameter 114. The direction parameter and the energy ratio parameters may in some embodiments be considered to be spatial audio parameters. In other words the spatial audio parameters comprise parameters which aim to characterize the sound-field captured by the microphone array audio signals.

In some embodiments the parameters generated may differ from frequency band to frequency band and may be particularly dependent on the transmission bit rate. Thus for example in band X all of the parameters are generated and transmitted, whereas in band Y only one of the parameters is generated and transmitted, and furthermore in band Z no parameters are generated or transmitted. A practical example of this may be that for some frequency bands such as the highest band some of the parameters are not required for perceptual reasons. The transport signals 104 and the metadata 106 may be transmitted or stored, this is shown in FIG. 1 by the dashed line 107. Before the transport signals 104 and the metadata 106 are transmitted or stored they are typically coded in order to reduce bit rate, and multiplexed to one stream. The encoding and the multiplexing may be implemented using any suitable scheme.

In the decoder side, the received or retrieved data (stream) may be demultiplexed, and the coded streams decoded in order to obtain the transport signals and the metadata. This receiving or retrieving of the transport signals and the metadata is also shown in FIG. 1 with respect to the right hand side of the dashed line 107.

The system 100 'synthesis' part 131 shows a synthesis processor 109 configured to receive the transport signals 104 and the metadata 106 and creates a suitable multi-channel audio signal output 116 (which may be any suitable output format such as binaural, multi-channel loudspeaker or Ambisonics signals, depending on the use case) based on the transport signals 104 and the metadata 106. In some embodiments with loudspeaker reproduction, an actual physical sound field is reproduced (using the loudspeakers) having the desired perceptual properties. In other embodiments, the reproduction of a sound field may be understood to refer to reproducing perceptual properties of a sound field by other means than reproducing an actual physical sound field in a space. For example, the desired perceptual properties of a sound field can be reproduced over headphones using the binaural reproduction methods as described herein. In another example, the perceptual properties of a sound field could be reproduced as an Ambisonic output signal, and these Ambisonic signals can be reproduced with Ambisonic decoding methods to provide for example a binaural output with the desired perceptual properties.

The synthesis processor 109 can in some embodiments be a computer (running suitable software stored on memory and on at least one processor), or alternatively a specific device utilizing, for example, FPGAs or ASICs.

Figure 2:
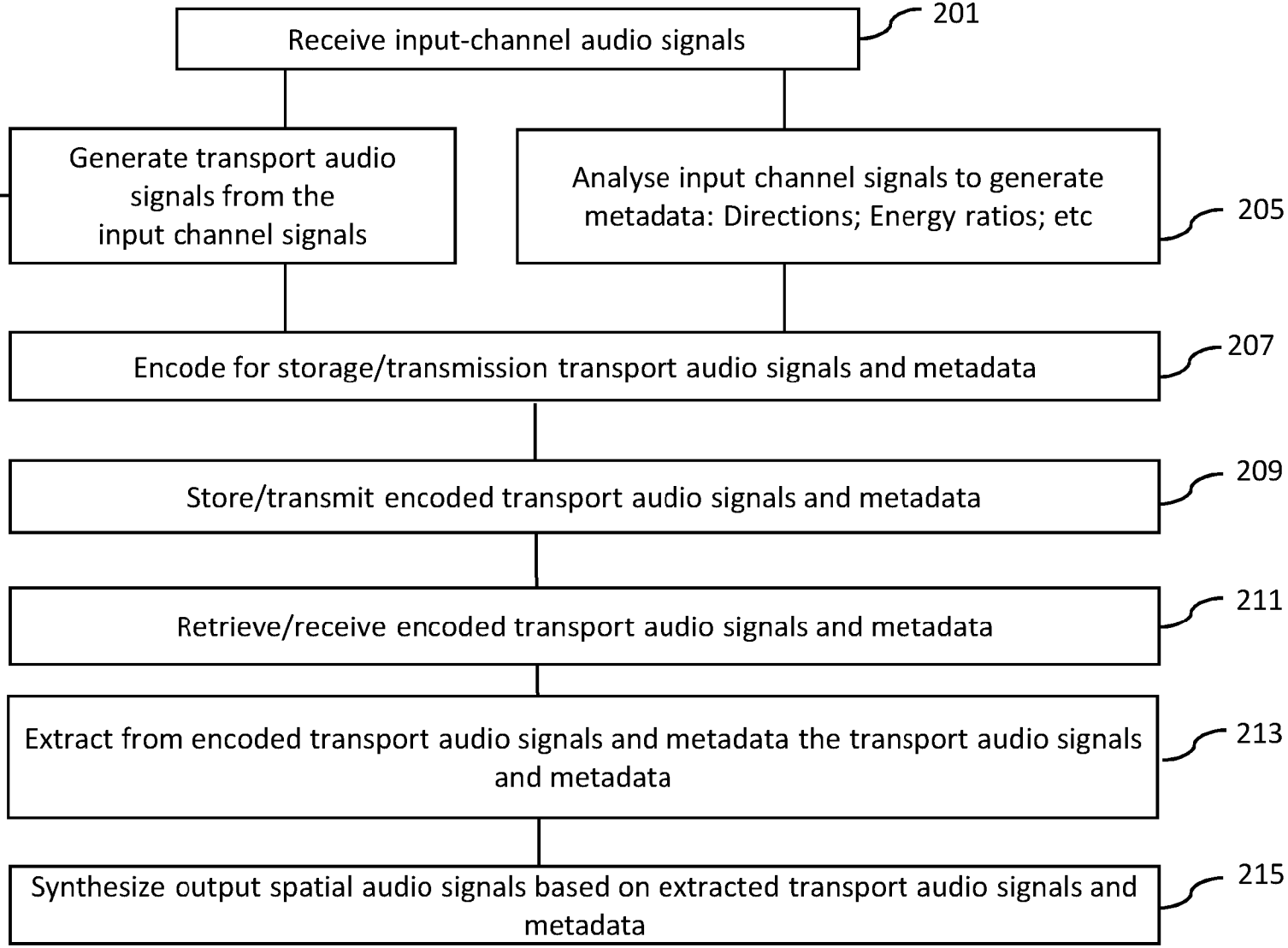
FIG. 2 shows a flow diagram of the operation of the system as shown in FIG. 1 according to some embodiments.

With respect to FIG. 2 an example flow diagram of the overview shown in FIG. 1 is shown.

First the system (analysis part) is configured to receive microphone array audio signals or suitable multichannel input as shown in FIG. 2 by step 201.

Then the system (analysis part) is configured to generate a transport signal channels or transport signals (for example downmix/selection/beamforming based on the multichannel input audio signals) as shown in FIG. 2 by step 203.

Also the system (analysis part) is configured to analyse the audio signals to generate metadata: Directions; Energy ratios (and in some embodiments other metadata such as Surrounding coherences; Spread coherences) as shown in FIG. 2 by step 205.

The system is then configured to (optionally) encode for storage/transmission the transport signals and metadata with coherence parameters as shown in FIG. 2 by step 207.

After this the system may store/transmit the transport signals and metadata with coherence parameters as shown in FIG. 2 by step 209.

The system may retrieve/receive the transport signals and metadata with coherence parameters as shown in FIG. 2 by step 211.

Then the system is configured to extract from the transport signals and metadata with coherence parameters as shown in FIG. 2 by step 213.

The system (synthesis part) is configured to synthesize an output spatial audio signals (which as discussed earlier may be any suitable output format such as binaural, multichannel loudspeaker or Ambisonics signals, depending on the use case) based on extracted audio signals and metadata with coherence parameters as shown in FIG. 2 by step 215.

In some embodiments a metadata format for each frame may be as shown hereafter.

| Adaptive resolution metadata format | | | |
|---|---|---|---|
| Field | Minimum bits | Augmented bits | Additional description |
| For each frame | | | |
| Version | 8 | | |
| Coding subbands | 3 | | Number of coarse TF-blocks to use for coding (probable value 5 or 6) |
| Number of directions | 1 | 8 | One or two |
| Configuration | 8 | N*8 | Describes the content properties of the Channels- part of the "Channels + Spatial Metadata" |
| Reserved | 4 | | |
| For each coding subband | | | |
| TF-divisor | 2 | 16 | Selects subband TF-tile division from: 1) 20 ms, 4*subbands, 2) 2*10 ms, 2*subbands, 3) 4*5 ms, subbands. These resulting TF-tiles are subframes and we always have 4*subbands of them in total. |
| For each subframe and direction | | | Ordered as: direction 1 subframe 1 . . . N, direction 2 subframe 1 . . . N |
| Direction index | 16 | | Using spherical grid |
| Energy ratio | 8 | | 0 . . . 1 |
| Spread coherence | 8 | | 0 . . . 1 |
| Distance | 8 | | Logarithmic scale |
| For each subframe | | | |
| Surround coherence | 8 | | For the rest of the energy 0 . . . 1 |

The "Configuration" data field may be stable over several frames, typically over several thousands of frames. Although in some examples the field can be adapted more often, the field may be fixed for the duration of the spatial audio file/call. Thus, the Configuration field is transmitted to the receiver only seldomly, e.g. only when changing. In some embodiments, the 'Configuration' field information may not be transmitted to the receiver at all. Instead, it may be used to drive, at least in part, an encoding mode selection in the encoder. The 'Configuration' field value may in these embodiments thus affect the type of encoding that is performed and/or the type of rendering effect that is targeted.

In further embodiments, a user input by a receiving user or, e.g., a receiver rendering mode selection, may result in a mode selection request communicated via in-band or out-of-band signalling to the transmitting device/encoder. This can affect the encoding mode selection that may be, at least in part, dependent on the 'Configuration' field.

In the following embodiments the coder 107 is configured to code the audio signals in a Channels+Spatial Metadata mode. This coder 107 in some embodiments receives as the input pulse code modulated (PCM) audio in either mono, stereo, or multichannel (first-order-ambisonics FOA or channel based or HOA such as HOA Transport Format (HTF)) configuration as well as accompanying spatial metadata. The spatial metadata consists of sound source directions (azimuth and elevation, or in other coordinate system), diffuse-to-total or direct-to-total energy ratio and also additional parameters such as spread and surround coherences, and distance of sound source for each frequency band.

In the following embodiments the implementation may produce a perceptual performance benefit where multiple source directions can be assigned for each frequency band. This is beneficial for higher bitrates when a high quality is required for even the most difficult audio scenarios such as overlapping talkers in a noisy environment.

The concept therein as described hereafter is that in addition to the direction metadata there is metadata describing the channel part of the audio representation. The channel audio can comprise direct microphone signal(s), or some processed version of the audio such as binaural rendered stereo signal or synthesised FOA or multichannel signal. Furthermore even in the case of direct microphone signals, there are several possibilities such as omnidirectional/cardioid/figure-8 microphone capture implementations. Since for example a cardioid is directional it has an inherent direction that should be known for optimal rendering. There is a benefit at rendering stage, if the configuration of the channels data is well known. This enables the ability to identify different rendering parameters for example in omnidirectional stereo and cardioid captured stereo.

The concept as discussed hereafter may be embodied in a mechanism for enabling carrying spatial audio signals in the channel part of the metadata format by inserting detailed information in the "Configuration" field, which enables using advanced audio effects such as focus, noise suppression, tracking and mixing as a part of an encoding framework, as efficiently as possible.

The channels part of the spatial audio signals in some embodiments may contain audio that does not itself comprise spatial information (i.e. it does not contain spatial cues such as direction of arrival in itself). The spatial cues may in some embodiments be purely represented and stored/transmitted by the spatial metadata. In some embodiments there may be some spatial cues in the audio signals as well. For example, it may be possible to see that sound is more to the left by comparing time differences between two transmitted channels (left and right).

This potential or partial separation of spatial cues and the audio signals allows the signal to actually carry other aspects or information on the audio, such as focus, audio zoom or noise removal. The channel signal can thus contain other auditory aspects such as separate front/back focus signals or main/secondary signals or noise suppressed/residual background signals or noise suppressed/non-noise suppressed signals. When the renderer determines the channel configuration, it can then process the channels signals properly and can render spatial audio while at same time allowing adjustments to front/back ratio, main/secondary balance, clean signal/noise ratio or source1/source2 mix based on the user preference.

In some embodiments where there is no user preference or the preference is not set, a default configuration is used. The default may in some embodiments be configured to produce a signal that is similar to unprocessed captured signal. In some other embodiments a default setting may be to generate noise-suppressed audio signals.

As various aspect or embodiments there may also be options that may be transmitted or stored within the "Configuration" field.

A series of various applications which may be identified within the configuration field are:

1. Front/Back Enhanced Signals Case

Figure 3A:
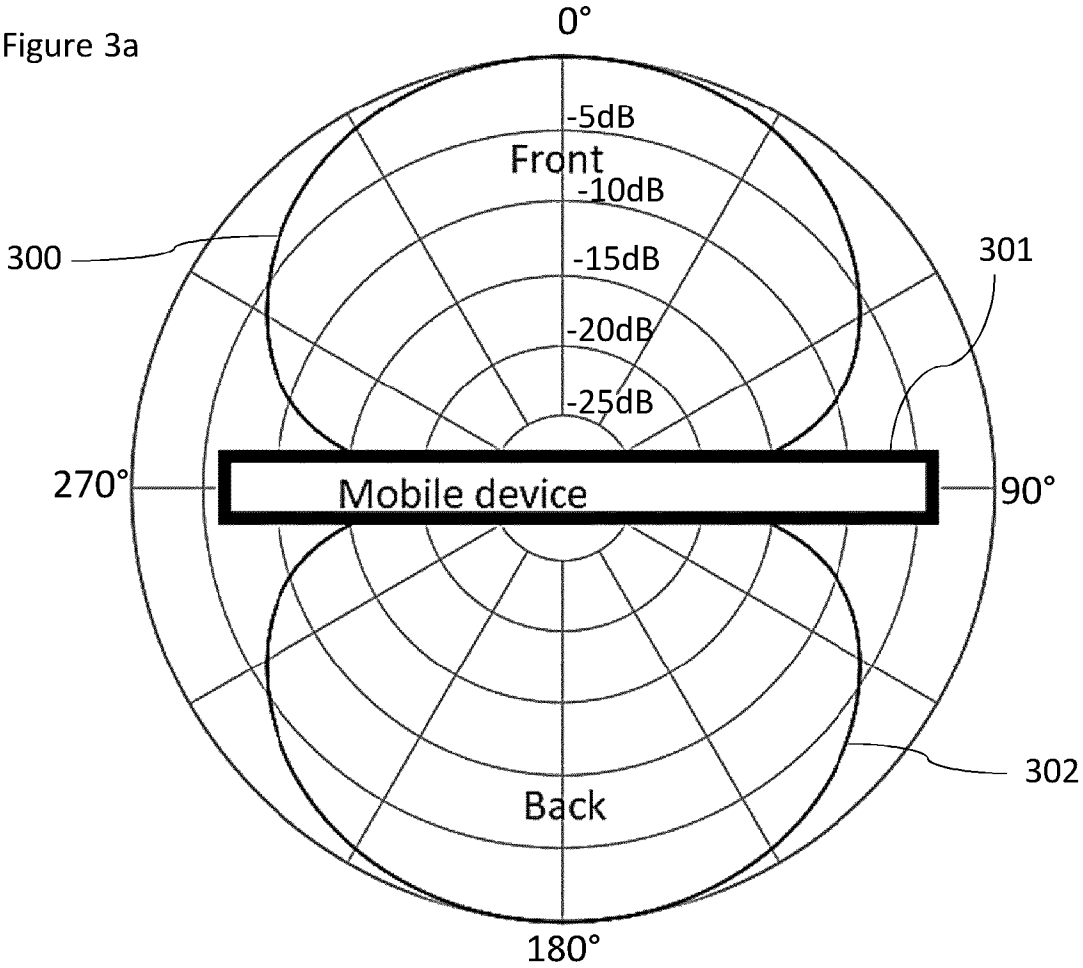
FIGS. 3*a* to 3*g* show focus configurations suitable for indicating in some embodiments.

In some embodiments, such as shown in FIG. 3*a*, the configuration field can be employed to indicate that the audio signals comprise a first channel, channel 1, which contains signal captured from a forwards direction (a first direction 300 with respect to the capture apparatus 301 which typically is in line with a main camera, or auxiliary camera field of view) and a second channel, channel 2, which contains signals captured from a backwards direction (a second direction 302 with respect to the capture apparatus 301 which is opposite to the first direction) rather than a 'traditional' left and right audio channel combination. This information may be received at the decoder side to correctly render the spatial audio. Additionally, with the knowledge of the signal content of channels it is possible to emphasize for example the front direction or back direction or render a spatial image based on the user requirements. In some embodiments the indication may be used to enable a balanced representation to be rendered. In some embodiments the Front/Back signal may be stereo, thus the amount of Channels signal is 2*stereo for a total of 4 channels. This will enable higher audio quality than using just two mono signals.

2. Noise Suppressed/Residual Signal Enhanced Signals Case

Another way to define the channels signal is to transmit noise suppressed signal and residual noise in channels 1 and 2 respectively. These signals can be combined in the decoder to render either a relatively clean main signal or alternatively the main signal can be ignored and the surrounding ambience can be listened instead. In some embodiments the signals are combined and balanced audio (original sounding) signal can be rendered. Furthermore in some embodiments the amount of noise suppression can be sent. The amount of noise suppression may vary from frame to frame and this can be used in advanced rendering to further enhance the rendered signal. In a similar manner to the front/back enhancement, there may be 2 stereo channels instead of two mono signals for a total of 4 channels.

3. Object Tracked/Residual Signal Enhancement

In some embodiments it may be possible to extract from an audio scene a single talker or sound source. This sound source may be mobile relative to the scene. This audio source can be sent in a spatial parameter encoded audio signal as a first channel. When the sound source is removed from the audio scene a second channel may be employed to carry the residual signal. At the decoder when the signals are summed together an original sounding sound scene can be rendered. In some embodiments, and based on user or other control inputs the balance between the separated sound source and the residual signal can be adjusted. In some embodiments there may be two stereo channels instead of two mono signals.

4. Main Signal/Residual Signal

In some embodiments it may be possible to employ microphone and signal processing to extract from audio signal(s) (sound separation) two different scenes. For example while capturing a live concert performance with mobile capture it may be possible to isolate the artist performance coming from loudspeakers from the audience noise. These two streams can be stored and transmitted separately. At the renderer a user or other control may be employed to balance the mix of these two streams while listening to the spatial audio.

5. Source 1/Source 2

In some embodiments scenarios such as voice conferencing and coded domain audio mixing may benefit from the possibility to transmit two separate channels audio streams together with either unified or two separate spatial parameter sets. These two streams can be stored and transmitted separately. At the renderer a user or other control may be employed to control the balance of these two streams while listening to the spatial audio.

6. Beam 1/Beam 2

In some embodiments microphone and signal processing algorithms may be employed to track and extract from audio signal(s) (for example employing beam forming) two different sound sources. For example while capturing a live performance of singer and guitar player with mobile capture it may be possible to isolate the singer performance from the guitar player. These two streams can be stored and transmitted separately as "channel signals". At the renderer a user or otherwise based control may be employed to control the balance of these two streams while listening to the spatial audio.

The channel configuration field may be represented in some embodiments as a structured table where the fields depend on the previous fields. An example case with 8 bits used for a configuration field is shown below. It is noted that the configuration field shown is an example only and that it may in some other embodiments differ in structure and bit allocation. However in the embodiments hereafter the concept may be reflected in that there are parameters that allow advanced processed signal representations such as those described above, for example "Front/Back focus", "Main signal/Residual signal", "Noise suppressed source/Residual noise", "Target tracking/Remainder signal", "Main signal1/Main signal2"

| Main metadata | 2 bits | High level channels data configuration | | | |
|---|---|---|---|---|---|
| | | Microphone | Binaural | Processing | Ambisonics |
| Sub metadata | 3 bits | Omni | HRTF 1 | Left/Right side focus (Default configuration) [Spatial processing SP] | A-Format |
| | | Subcardioid | HRTF 2 | Front/Back focus (Case 1) [SP] | B-Format |
| | | Cardioid | HRTF 3 | Noise suppressed/ Residual noise (Case 2) | 4 quadrants (see FIG. 3g) |
| | | Hyper cardioid | HRTF 4 | Target tracking/ Remainder signal (Case 3) [SP/nSP] | HTF |
| | | Super cardiod | nd | Main signal/ Residual signal (Case 4) [SP/nSP] | Not defined (nd) |
| | | Shotgun | nd | Source 1/ Source 2 (Case 5) [SP/nSP] | nd |
| | | FIG-8/Mid - Side | nd | Beam 1/Beam 2 (Case 6) [SP] | nd |
| | | Boundary | nd | nd | nd |
| Subsub metadata | 3 bits | Microphone type specific metadata | direction | Focus amount in dB | Normalization |
| | | Omni Cardioid | for all | for all | B-format |
| | | 1 cm LR side +−90 | 0 | 3 dB | SN3D |
| | | 2 cm LR front +−45 | 45 | 6 dB | SN2D |
| | | 4 cm LR back +−135 | 90 | 9 dB | |
| | | 8 cm LR front +−20 | 135 | 12 dB | |
| | | 16 cm LR back +−110 | 180 | 15 dB | |
| | | 32 cm LR front nd | 225 | 18 dB | |
| | | 64 cm LR back nd | 270 | 21 dB | |
| | | 128 cm nd | 315 | 24 dB | |

As such the concept as discussed in further detail hereafter in the embodiments is one which relates to audio encoding and decoding using a sound-field related parameterization (direction(s) and ratio(s) in frequency bands). Further the embodiments relate to a solution to enable user-controllable effects on the sound fields encoded with the aforementioned parameterization and where the user-controllable effects are enabled by: conveying channel signal capture and processing related parameters along with the directional parameter(s) and reproducing the sound based on the directional parameter(s), the channel signal capture and processing related parameters, and user preference or user control input, such that the channel signal capture and processing related parameters and the user preference or user control input affect the sound-field synthesis using the direction(s) and ratio(s) in frequency bands.

Furthermore in some embodiments there is provided the ability to indicate to the renderer and the user what effect control processing is possible given the channel capture and processing related parameters. The renderer and/or user can then adjust how the audio is rendered given the possibilities allowed by the channel capture and processing parameters.

In some embodiments the channel configuration field contains detailed characteristics with respect to the channels-part of the channels+spatial metadata. In other words the channel configuration may be considered as metadata of the channels signal representation. The field may therefore contain relevant information, such as what each signal channel contains, how it was captured or how it was processed and how it should be rendered (for optimal quality). For example the field may contain information such as front/back or noise suppressed/residual signals that allows the renderer (with user controls) to perform effects such as audio zooming to desired direction, or removal of unwanted signal components.

In some embodiments the Main metadata channel configuration is defined with 2 bits such as shown in the following table:

| Index | Audio signal contained in spatial channels | Notes |
|---|---|---|
| 0 | Microphone captured signal | Only traditional microphone processing (e.g. equalization or gain adjustment, but no beam forming or stereo processing) |
| 1 | Binaural signal | Binauralization generated with some of the known algorithms with known HRTF's |
| 2 | Processed signal | Advanced processing is used to generate this kind of channels signal(s). With the knowledge of the processing, the audio renderer can generate original sounding spatial audio or by user request make some enhancement on the rendering. |
| 3 | Reserved | — |

The first option, index 0, is the microphone captured scenario. This option describes the scenario where the "channels" contain pure microphone signals and what kind of microphone configuration was used.

The second option, index 1, is binaural stereo scenario. The use of binauralization is that even without help of spatial metadata is that when rendering or listening with headphones the output may produce a reasonable static spatial audio reproduction. However, with the help of spatial metadata headtracking can be enabled and with relevant configuration information such as head-related transfer-function (HRTF) information personalized HRTF can be robustly selected and better quality can be achieved.

The third option, index 2, selects the mode, where advanced operation modes such as audio zooming, object tracking or user adjustable noise suppression are enabled as further described in the following examples and embodiments.

The fourth option, index 3, may be reserved for future use to provide suitable futureproofing of the signalling.

If the high level configuration field signals that the scenario is a microphone captured signal the next field identifies a microphone type with 3 bits. An example signalling of the microphone type may be as follows:

| Index | Microphone type | Notes |
|---|---|---|
| 0 | Omni | default |
| 1 | Sub-cardioid | |
| 2 | Cardioid | |
| 3 | Hyper cardioid | |
| 4 | Super cardioid | |
| 5 | Shotgun | Far field audio capture |
| 6 | FIG.-8/MS-stereo | Channels are crossed by 90 degrees |
| 7 | Boundary | half sphere on the back is blocked |

Figure 3B:
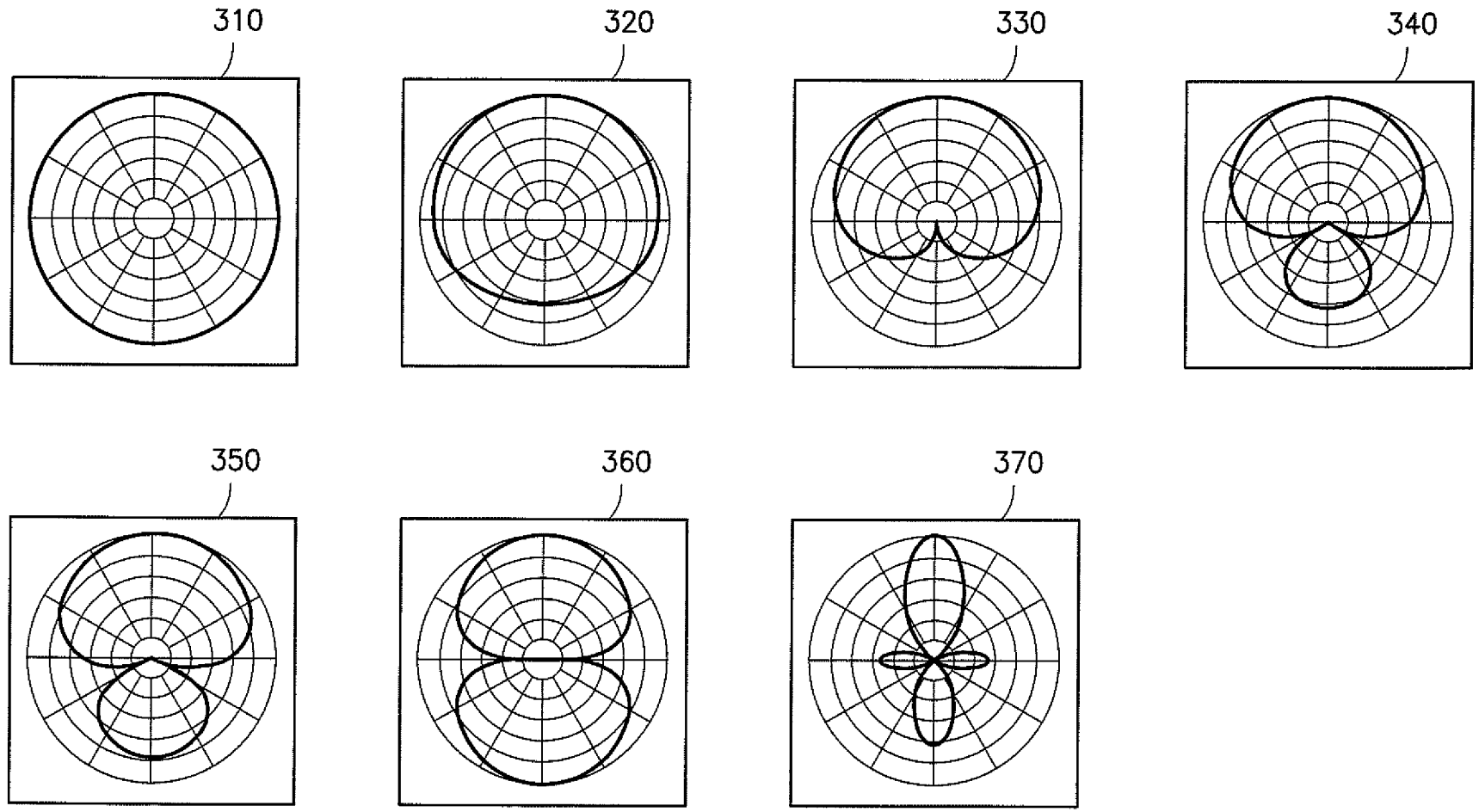

For example a first option, index 0, an omnidirectional (omni) pattern is shown in FIG. 3*b* by microphone pattern 310. This may be considered a default type.

A second option, index 1, a sub-cardioid pattern is shown in FIG. 3*b* by microphone pattern 320. In addition to omni, this is also a commonly used type.

A third option, index 2, a cardioid pattern is shown in FIG. 3*b* by microphone pattern 330. In addition to omni, this is also a commonly used type.

A fourth option, index 3, a hyper-cardioid pattern is shown in FIG. 3*b* by microphone pattern 340.

A fifth option, index 4, a super-cardioid pattern is shown in FIG. 3*b* by microphone pattern 350.

A sixth option, index 5, a shotgun pattern is shown in FIG. 3*b* by microphone pattern 370.

A seventh option, index 6, a figure-8 pattern is shown in FIG. 3*b* by microphone pattern 360.

An eighth option, index 7, a boundary pattern which is a pattern wherein half of the sphere is blocked.

Figure 3C:
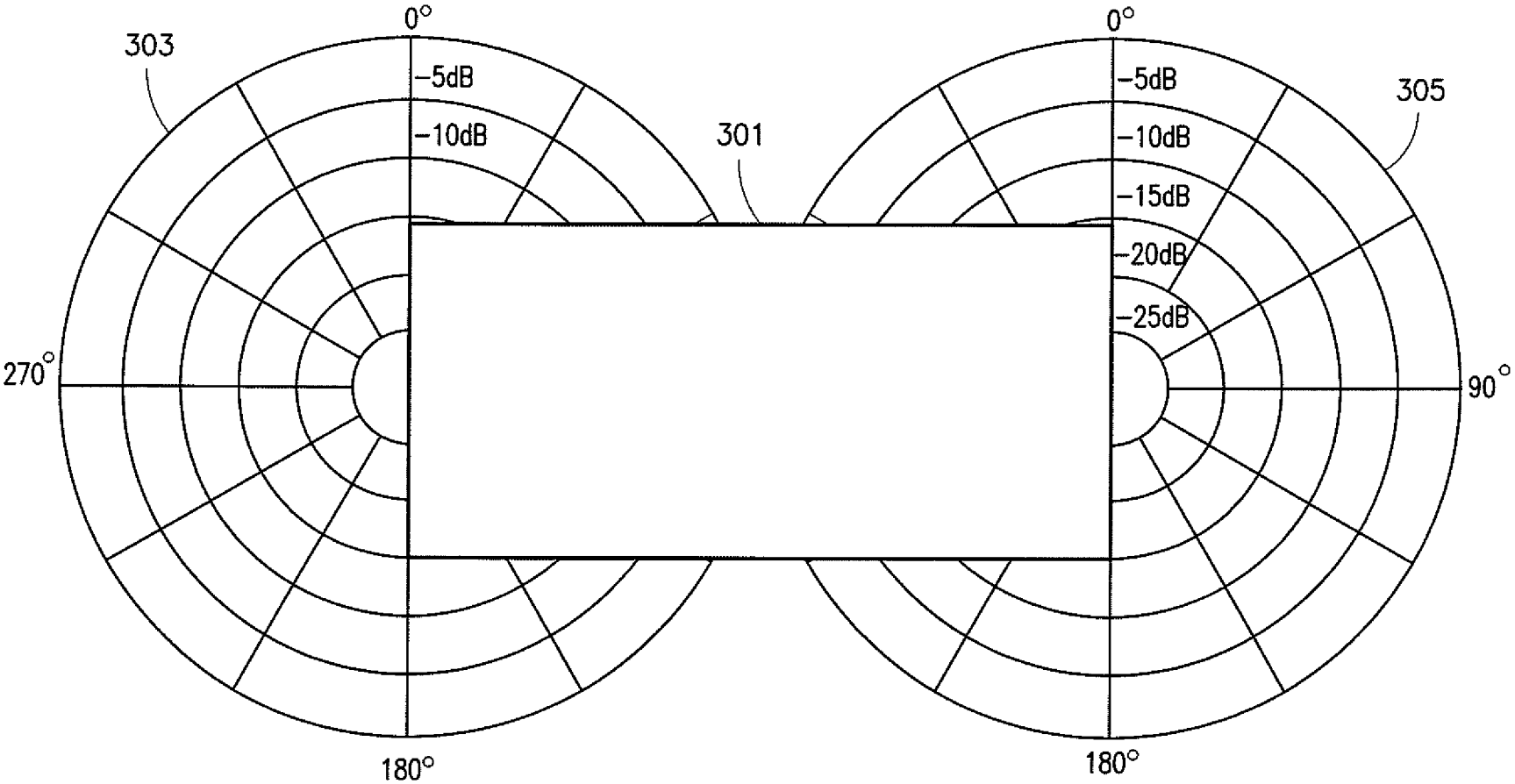

A practical example of the first option (index 0) is shown in FIG. 3*c* which shows an apparatus 301 omnidirectional microphone pair 303, 305 separated by some distance (e.g. 16 cm in case of mobile phone and when the microphones are on the edges of the phone).

Figure 3D:
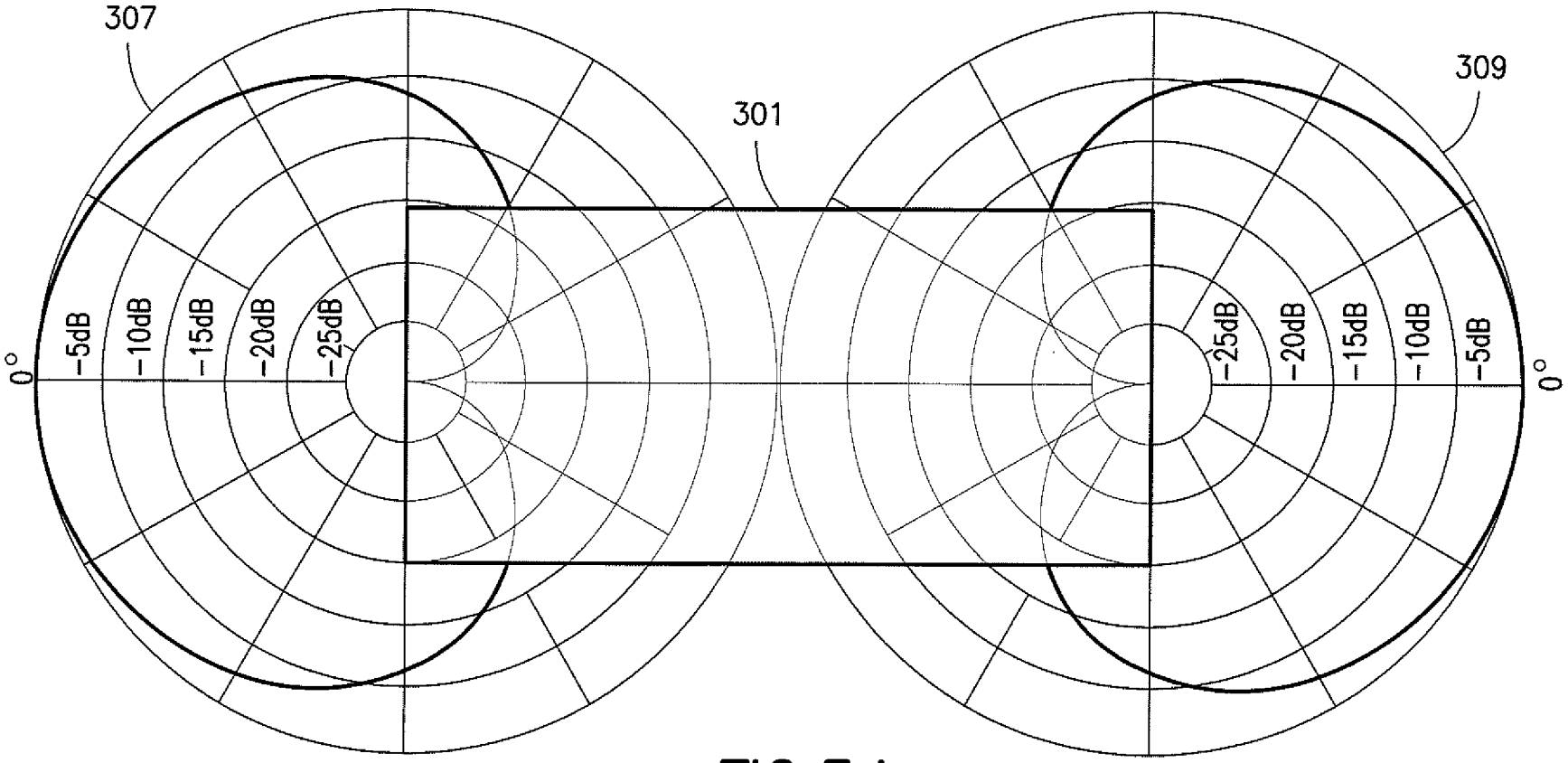

A further practical option (index 2) is shown in FIG. 3*d* which shows apparatus 301 comprising a cardioid microphone pair 307, 309 pointing sideways (and capturing left and right spheres of audio).

Either of the omnidirectional or cardioid pairs are able to produce high coverage 360-degree spatial audio capture.

Figure 3E:
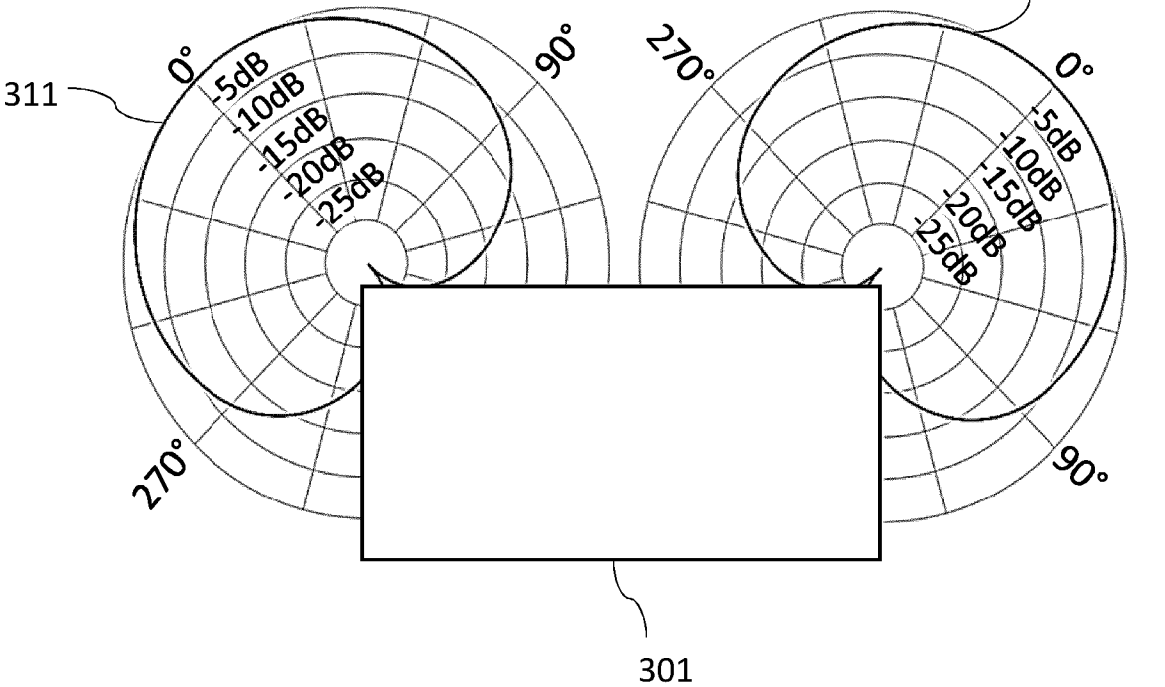

FIG. 3*e* shows a further alternative practical microphone configuration, where there are two cardioid microphones 311, 315 pointing to the forward direction. In this example a backwards direction has significant suppression. This microphone configuration is not optimal for 360 degree spatial audio. However, with the help of this microphone configuration information the renderer may be able to enhance the spatial performance.

Figure 3F:
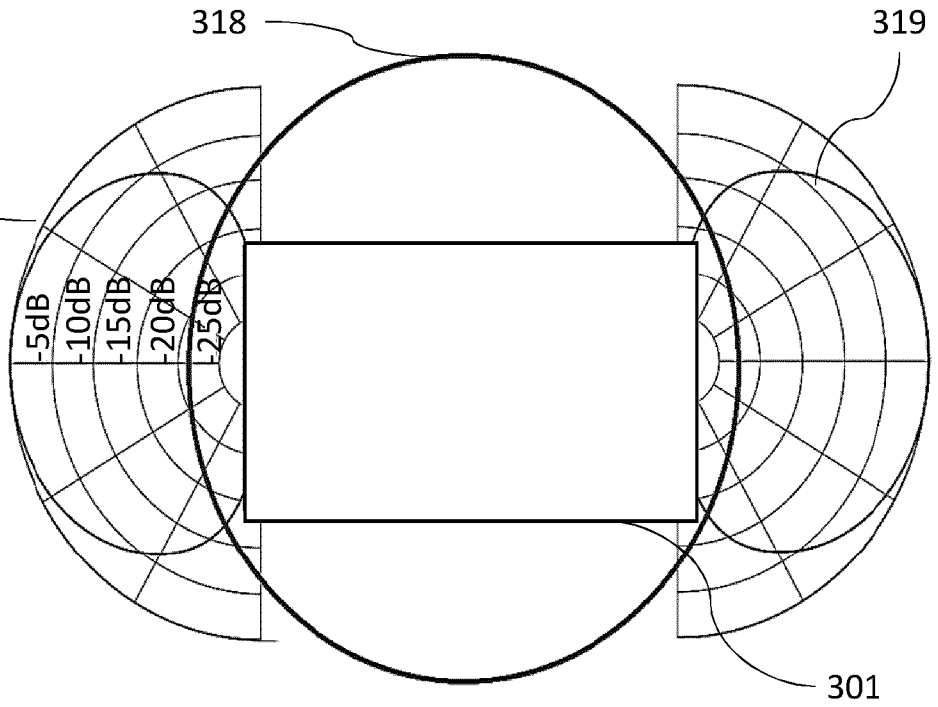

FIG. 3*f* shows another example microphone configuration where two cardioid microphones 317 and 319 and an omnidirectional microphone 318 are able to produce a Mid-Side stereo configuration. The first channel contains omnidirectional microphone 318 capture of audio field and the second channel contains side information from the cardioid microphones 317 and 319. In such embodiments all directions of sound arrival are captured. However, processing at rendering is different compared to the examples shown in FIGS. 3*d* and 3*e*.

Figure 3G:
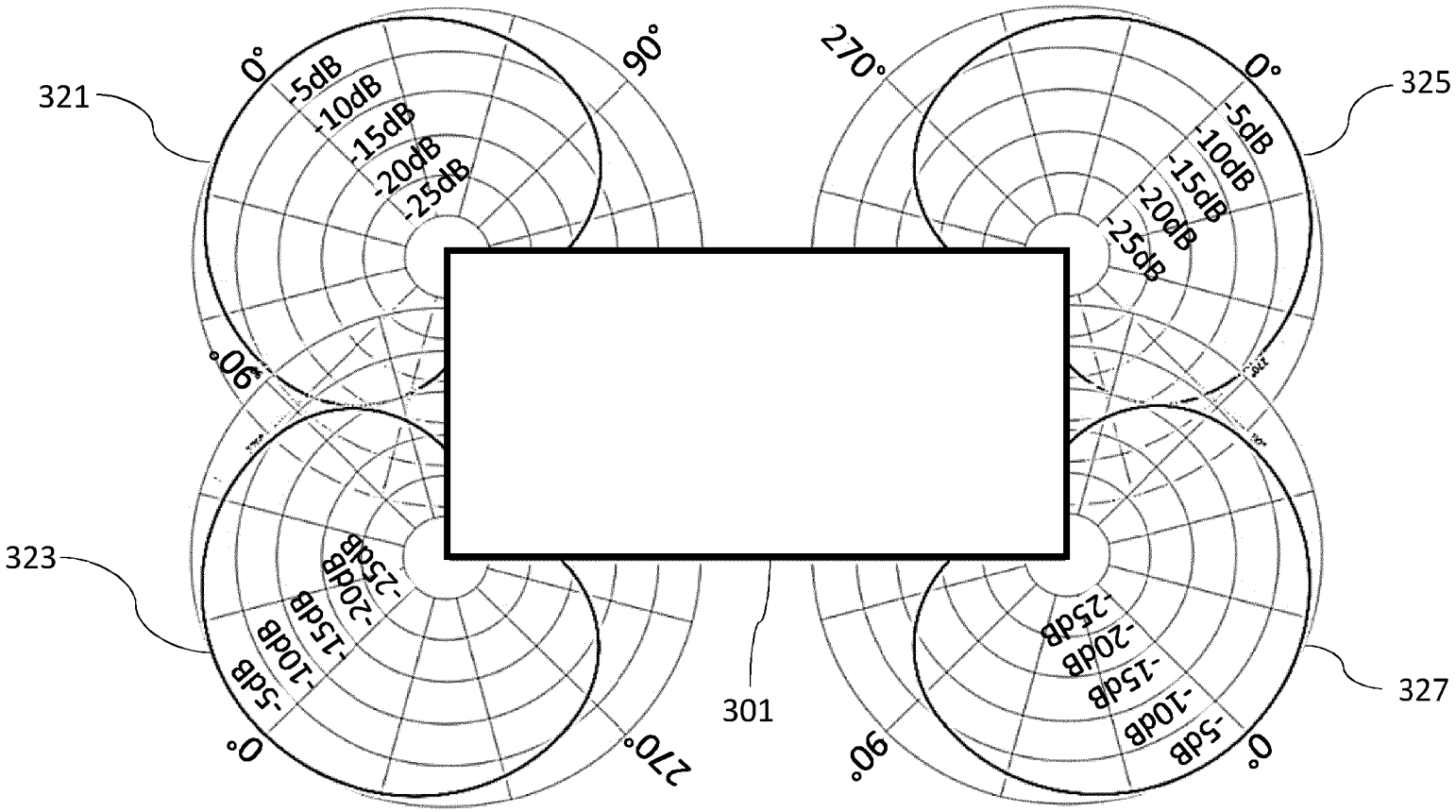

FIG. 3*g* shows a further practical example microphone configuration where four cardioid microphones 321, 323, 325, and 327 are able to produce a quadrant sound field capture. This arrangement allows a front/back adjustment.

In some embodiments where the signal type is defined as processed, the next field signals or indicates the processing options. Examples of processing options are shown in the following table. In some embodiments a default configuration is Left/Right side focus, which is just Left Right stereo with enhanced stereo image.

| Index | Processing options | Notes |
|---|---|---|
| 0 | Left/Right side focus | default, normal enhanced stereo |
| 1 | Front/Back focus | There are separate front and back signals. Adjusting the balance is possible at the receiving end. |
| 2 | Main signal/Residual | There are separate main and residual signals. Adjusting the balance is possible at the receiving end. |
| 3 | Noise suppressed/ Residual noise | There are separate noise suppressed and residual noise signals. Adjusting the balance is possible at the receiving end. |
| 4 | Target tracking/The remaining signal | There are separate source objects: tracked and any other audio signals. Adjusting the balance is possible at the receiving end. |
| 5 | Source 1/Source 2 | There are separate sources, which may come from different places. Adjusting the mix is possible at the receiving end. |
| 6 | Beam 1/Beam 2 | There are separate sources created by beam forming. Adjusting the balance is possible at the receiving end. |
| 7 | Left/Right front focus | Frontside is emphasized in microphone processing. Good for capturing the main presentation. |
| 8 | Left/Right back focus | Backside is emphasized in microphone processing. Good for capturing the comments of the person doing the capture. |

In some embodiments for binaural stereo there are configuration fields that describe which algorithm and HRTFs were used for generation of the binauralization. Since the algorithm is known, the renderer may be configured to process some parameters based on user request. For example, in some embodiments the renderer may be configured to change the playback equalization or renderer HRTFs to better suit the listener preferences.

| Index | HRTF selection | |
|---|---|---|
| 0 | HRTF 1 | default |
| 1 | HRTF 2 | |
| 2 | HRTF 3 | |
| 3 | HRTF 4 | |
| 4 | HRTF . . . | |
| 5 | | |
| 6 | | |
| 7 | | |

In some embodiments additional information about the microphone positions and where they are pointing or directed may also be embedded or signalled in the configuration field.

For example in some embodiments the renderer may benefit from knowledge of the directions of the audio captured from microphones with directional properties. For example in some embodiments the directions or pointing direction may be signalled using the following indices.

| Index | HRTF selection | |
|---|---|---|
| 0 | Left - Right side (+−90 deg) | default for sub-cardiod and cardioid |
| 1 | Left - Right front focus (+−45 deg) | default for super/hyper cardioid |
| 2 | Left - Right back focus (+−135 deg) | |
| 3 | Left - Right front focus (+−20 deg) | Frontal stereo zoom |
| 4 | Left - Right back focus (+−110 deg) | Backward stereo zoom |
| 5 | Left - Right front focus (+−75 deg) | Wide stereo image |
| 6 | Left - Right front focus (both forwards) | Both beams are point straight ahead, for maximum stereo zoom. |
| 7 | Left - Right back focus (both) | Both beams are point straight backwards for maximum stereo zoom. |

In some embodiments the microphone type configuration is described with three bits. In some embodiments where more bits are used for configuration, more detail may be provided about the microphone location, beam bandwidth and/or direction.

In some embodiments, for omni-directional microphones there may be a descriptive field which signals using three bits (or more if available) the approximate omni-microphone distance. In some embodiments this distance axis is the L-R.

| Index | Base distance | Notes |
|---|---|---|
| 0 | 1 cm | Thin edge of device (on opposite sides, some occlusion assumed) |
| 1 | 2 cm | |
| 2 | 4 cm | E.g. rugged camera style device |
| 3 | 8 cm | |
| 4 | 16 cm | Default (Quite common mobile phone length, approximate distance between human ears) |
| 5 | 32 cm | On laptop/monitor sides |
| 6 | 64 cm | On small table |
| 7 | 128 cm | Microphones on the edges of table, large conference room |

In some embodiments where the microphones are Front/Back, Noise Suppressed/Residual Noise, Main Signal/Remainder, or Tracked Object/Remainder the configuration field further comprises a field which indicates the estimated channel separation in decibels. This information allows better rendering at the renderer/decoder and enables the renderer to present the user a proper scale when setting the preferences.

| Index | Processing gain | Notes |
|---|---|---|
| 0 | <3 dB | weak processing |
| 1 | 6 dB | |
| 2 | 9 dB | |
| 3 | 12 dB | default |
| 4 | 15 dB | |
| 5 | 18 dB | |

-continued

| Index | Processing gain | Notes |
|---|---|---|
| 6 | 21 dB | |
| 7 | >24 dB | strong processing |

Figure 4:
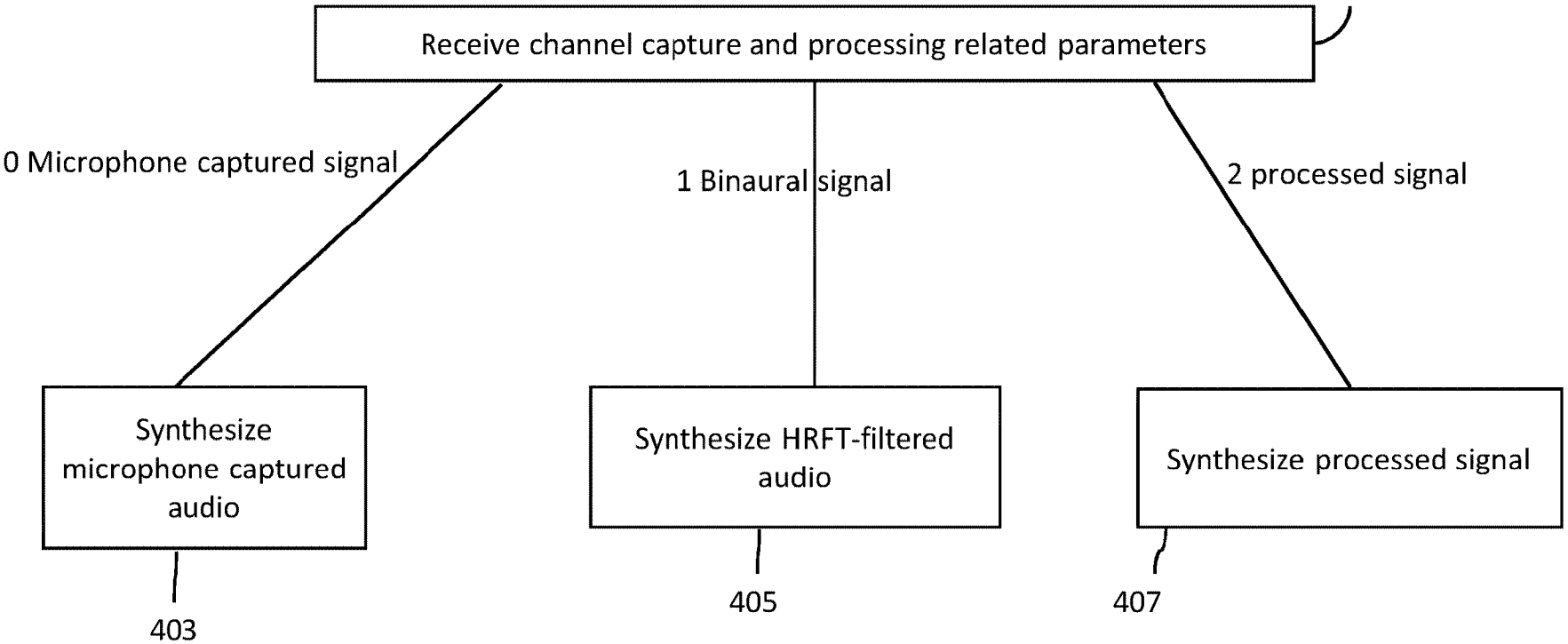
FIG. 4 shows a flow diagram of the operation of processing according to some embodiments.

With respect to FIG. 4 there is shown a flow diagram which shows an example method according to some embodiments. When the decoder receives the capture and processing related parameters, it determines the appropriate method for synthesizing the signal based on the main channel configuration index value as shown in FIG. 4 by step 401.

If the main channel configuration index value indicates a 0 index value, a microphone captured signal, then the method proceeds to synthesize the audio output with methods dedicated to synthesizing audio with microphone captured signals and parametric metadata as shown in FIG. 4 by step 403.

If the main channel configuration index value indicates 1 index value, a binaural signal, then the method proceeds to render a HRTF-filtered audio signal, for example a binaural output suitable for headphones as shown in FIG. 4 by step 405.

If the main channel configuration index value indicates 2 index value, a processed signal, the renderer/decoder may be configured to synthesize an audio output from processed signals as shown in FIG. 4 by step 405.

Figure 5:
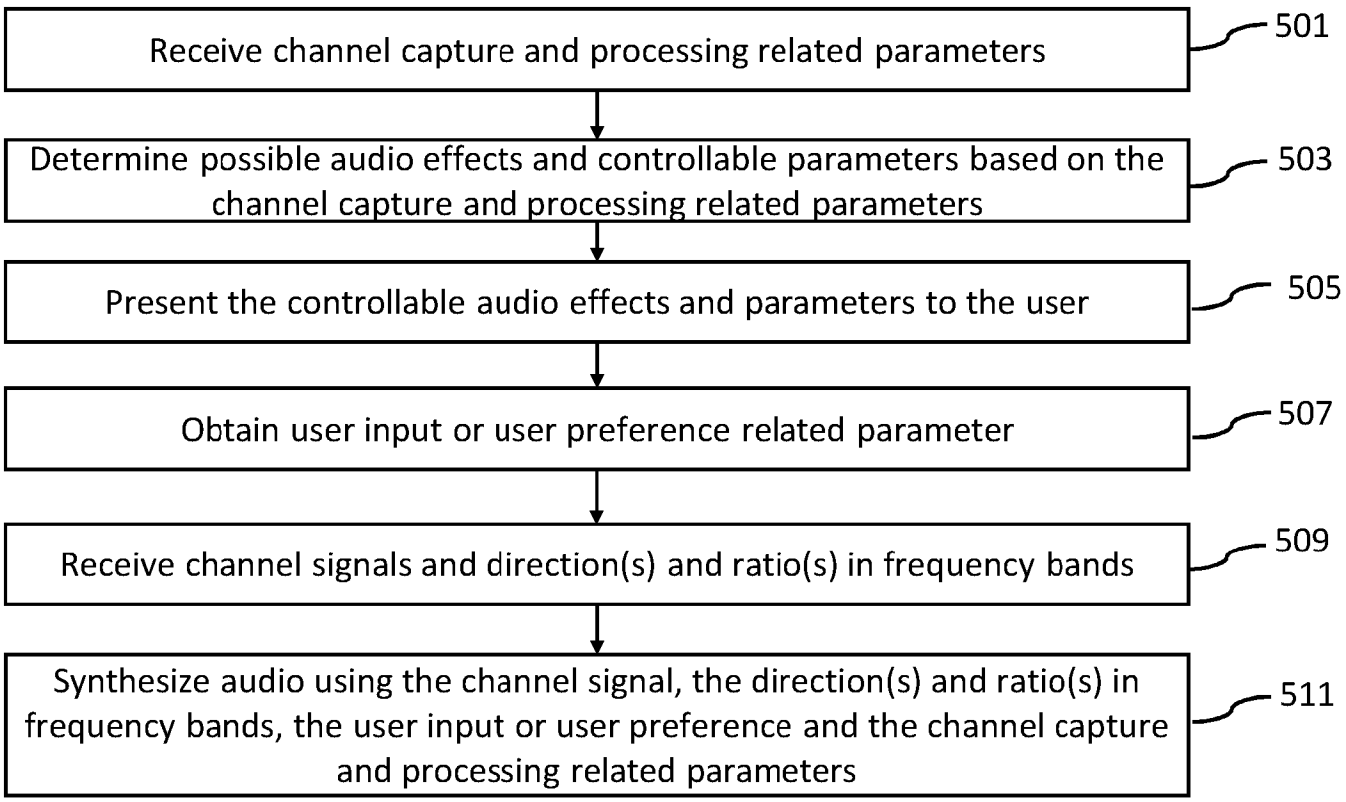
FIG. 5 shows a flow diagram of the operation of synthesizing according to some embodiments.

With respect to FIG. 5 is shown an example of a method for synthesising output where the main channel index value indicates a processed signal (an index value of 2 as shown in the examples above).

The renderer/decoder 131 may be configured to first obtain the channel capture and processing related parameters described above as shown in FIG. 5 by step 501.

Then based on the capture and processing related parameters, the renderer/decoder 131 may be configured to determine what audio effects are possible and what parameters can be controlled and the allowable ranges for control as shown in FIG. 5 by step 503. For example, if no capture and processing related parameters are provided, no effects can be synthesized and no controllable parameters are available. If, however, the processed options field within the configuration information provides options, some effects and parameter controls are possible:

Front/Back focus: having separate front and back signals enables controlling the front/back ratio. The method obtains the default value which reproduces a spatial audio signal close or equivalent to an unprocessed version, for example, 0.5. The method obtains the extreme values for the front/back ratio, 1 for full front and 0 for full back.

Main signal/Residual: having separate main and residual signals enables controlling the ratio for main and residual. The default ratio value of 0.5 reproduces a spatial audio signal close or equivalent to an unprocessed version. The method obtains the extreme values for the main to residual ratio, 1 for main only and 0 for residual only.

Noise suppressed/Residual noise: having separate noise-suppressed and residual signals enables controlling the ratio for noise-suppressed and residual. The default ratio value of 0.5 reproduces a spatial audio signal close or equivalent to an unprocessed version. The method obtains the extreme values for the noise suppressed to residual ratio, 1 for noise-suppressed only and 0 for residual only.

Target tracking/remaining signal: having separate target tracked and remaining signals enables controlling the ratio for target tracked and remaining signal. The default ratio value of 0.5 reproduces a spatial audio signal close or equivalent to an unprocessed version. The method obtains the extreme values for the target tracked to remaining ratio, 1 for target-tracked only and 0 for remainder only.

Source 1/source 2: two audio sources can be combined into a single spatial audio stream either by the sender or some network element e.g. voice conferencing bridge. This enables the spatial audio mixer to work with no additional latency and low computational complexity, since audio stream decoding/encoding can be omitted. The spatial metadata parameters can be either be combined or two separate streams can be received and decoded. The default ratio value of 0.5 reproduces a spatial audio signal close or equivalent to even mix-down. The method obtains the extreme values for the source selection to remaining ratio, 1 for source 1 only and 0 for source 2 only.

Beam 1/Beam 2: having separate targeted sound sources enables controlling the ratio between the sound sources. The default ratio value of 0.5 reproduces a spatial audio signal close or equivalent to an unprocessed version. The method obtains the extreme values for the source selection to remaining ratio, 1 for beam 1 only and 0 for beam 2 only.

When the controllable audio effects, parameters, and the parameter ranges are determined, they may then be depicted or displayed to the user as shown in FIG. 5 by step 507.

The depiction can be done via sliders or other UI control mechanisms. The depiction can be done via UI graphics which depict a visualization related to the range of the effect given the ranges of the adjustable parameters. For example, if the effect is related to audio zoom in a certain direction, the depiction on a UI can indicate the expected virtual microphone patterns obtained with different values of the zoom control parameter.

When the available effects and their control parameters are depicted to the user, the user may then make adjustments/selections with respect to the effects or parameter values. For example, the user may adjust the audio zoom.

The decoder/renderer may then determine a parameter related to the effect, either as an explicit input from the user or from a generic preference. A generic preference can be defined by the user related to a usage situation or may be a default selection. For example, a preference can describe that always apply audio focus towards front by a certain amount when possible. The determination or obtaining of the parameter based on the user input/default selection is shown in FIG. 5 by step 507.

The decoder/renderer may then be configured to receive the channel signals and other metadata, such as the directions(s) and ratio(s) in frequency bands as shown in FIG. 5 by step 509.

The decoder/renderer may then be configured to synthesize the audio signals. For audio synthesis, the method requires the received channel signal content and the directions and ratios which describe the spatial metadata. Using the channel signals, the directions and ratios at frequency bands, and the provided capture and processing related parameters the decoder/renderer then synthesizes the audio. The provided capture and processing related parameters dictate which synthesis method is selected, and the provided control parameters adjust the parameters of the synthesis as shown in FIG. 5 by step 511.

Figure 6:
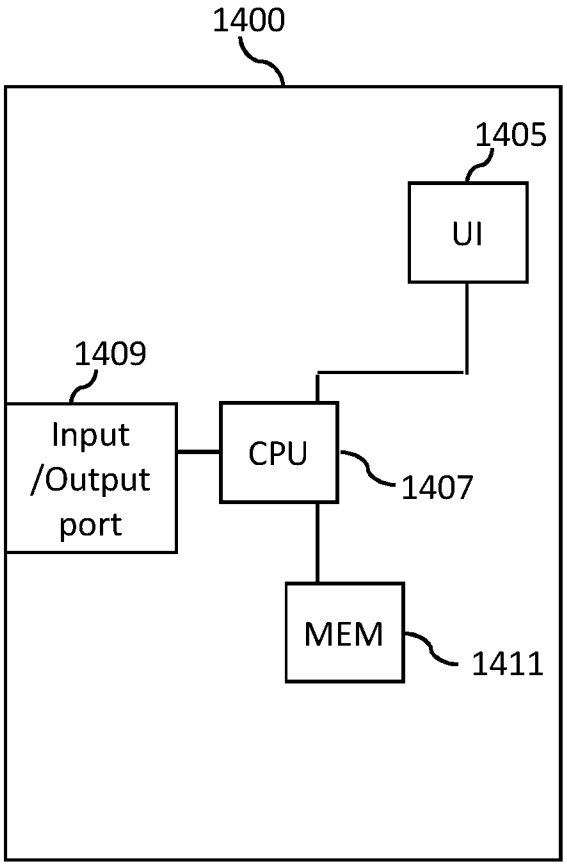
FIG. 6 shows schematically an example device suitable for implementing the apparatus shown herein.

With respect to FIG. 6 an example electronic device which may be used as the analysis or synthesis device is shown. The device may be any suitable electronics device or apparatus. For example in some embodiments the device 1400 is a mobile device, user equipment, tablet computer, computer, audio playback apparatus, etc.

In some embodiments the device 1400 comprises at least one processor or central processing unit 1407. The processor 1407 can be configured to execute various program codes such as the methods such as described herein.

In some embodiments the device 1400 comprises a memory 1411. In some embodiments the at least one processor 1407 is coupled to the memory 1411. The memory 1411 can be any suitable storage means. In some embodiments the memory 1411 comprises a program code section for storing program codes implementable upon the processor 1407. Furthermore in some embodiments the memory 1411 can further comprise a stored data section for storing data, for example data that has been processed or to be processed in accordance with the embodiments as described herein. The implemented program code stored within the program code section and the data stored within the stored data section can be retrieved by the processor 1407 whenever needed via the memory-processor coupling.

In some embodiments the device 1400 comprises a user interface 1405. The user interface 1405 can be coupled in some embodiments to the processor 1407. In some embodiments the processor 1407 can control the operation of the user interface 1405 and receive inputs from the user interface 1405. In some embodiments the user interface 1405 can enable a user to input commands to the device 1400, for example via a keypad. In some embodiments the user interface 1405 can enable the user to obtain information from the device 1400. For example the user interface 1405 may comprise a display configured to display information from the device 1400 to the user. The user interface 1405 can in some embodiments comprise a touch screen or touch interface capable of both enabling information to be entered to the device 1400 and further displaying information to the user of the device 1400.

In some embodiments the device 1400 comprises an input/output port 1409. The input/output port 1409 in some embodiments comprises a transceiver. The transceiver in such embodiments can be coupled to the processor 1407 and configured to enable a communication with other apparatus or electronic devices, for example via a wireless communications network. The transceiver or any suitable transceiver or transmitter and/or receiver means can in some embodiments be configured to communicate with other electronic devices or apparatus via a wire or wired coupling.

The transceiver can communicate with further apparatus by any suitable known communications protocol. For example in some embodiments the transceiver or transceiver means can use a suitable universal mobile telecommunications system (UMTS) protocol, a wireless local area network (WLAN) protocol such as for example IEEE 802.X, a suitable short-range radio frequency communication protocol such as Bluetooth, or infrared data communication pathway (IRDA).

The transceiver input/output port 1409 may be configured to receive the loudspeaker signals and in some embodiments determine the parameters as described herein by using the processor 1407 executing suitable code. Furthermore the device may generate a suitable transport signal and parameter output to be transmitted to the synthesis device.

In some embodiments the device 1400 may be employed as at least part of the synthesis device. As such the input/output port 1409 may be configured to receive the transport signals and in some embodiments the parameters determined at the capture device or processing device as described herein, and generate a suitable audio signal format output by using the processor 1407 executing suitable code. The input/output port 1409 may be coupled to any suitable audio output for example to a multichannel speaker system and/or headphones or similar.

As used in this application, the term "circuitry" may refer to one or more or all of the following:

(a) hardware-only circuit implementations (such as implementations in only analogue and/or digital circuitry) and (b) combinations of hardware circuits and software, such as (as applicable):

(i) a combination of analogue and/or digital hardware circuit(s) with software/firmware and (ii) any portions of hardware processor(s) with software (including digital signal processor(s)), software, and memory(ies) that work together to cause an apparatus, such as a mobile phone or server, to perform various functions) and (c) hardware circuit(s) and or processor(s), such as a microprocessor(s) or a portion of a microprocessor(s), that requires software (e.g., firmware) for operation, but the software may not be present when it is not needed for operation. This definition of circuitry applies to all uses of this term in this application, including in any claims. As a further example, as used in this application, the term circuitry also covers an implementation of merely a hardware circuit or processor (or multiple processors) or portion of a hardware circuit or processor and its (or their) accompanying software and/or firmware. The term circuitry also covers, for example and if applicable to the particular claim element, a baseband integrated circuit or processor integrated circuit for a mobile device or a similar integrated circuit in server, a cellular network device, or other computing or network device.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. An apparatus comprising:

at least one processor; and at least one non-transitory memory including a computer program code, the at least one memory and the computer program code configured to, with the at least one processor, cause the apparatus at least to:

define at least one parameter field associated with an input multi-channel audio signals, the at least one parameter field configured to describe at least one characteristic of the input multi-channel audio signals, wherein the at least one characteristic is configured to identify a type of the input multi-channel audio signals;

determine at least one spatial audio parameter associated with the input multi-channel audio signals; and control a rendering of the input multi-channel audio signals with processing the input multichannel audio signals using at least the at least one characteristic of the input multi-channel audio signals and the at least one spatial audio parameter.

2. The apparatus as claimed in claim 1, wherein the type of the input multi-channel audio signals comprises at least one of:

microphone captured multi-channel audio signals;
binaural audio signals;
signal processed audio signals;
enhanced signal processed audio signals;
noise suppressed signal processed audio signals;
source separated signal processed audio signals;
tracked source signal processed audio signals;
spatial processed audio signals;
advanced signal processed audio signals; or ambisonics audio signals.

3. The apparatus as claimed in claim 1, wherein the apparatus is configured to define the at least one parameter field to comprise at least one second field configured to identify a characteristic associated with the type of the input multi-channel audio signals.

4. The apparatus as claimed in claim 3, wherein the characteristic, when the type of the input multi-channel audio signals is microphone captured multi-channel audio signals, is configured to cause the apparatus to one of:
identify a microphone profile for at least one microphone of a microphone array caused to capture the microphone captured multi-channel audio signals;
identify a configuration of the microphone array caused to capture the microphone captured multi-channel audio signals; or
identify a location and/or arrangement of at least two microphones within the microphone array caused to capture the microphone captured multi-channel audio signals.

5. The apparatus as claimed in claim 4, wherein the microphone profile comprises at least one of:
an omnidirectional microphone profile;
a subcardoid directional microphone profile;
a cardoid directional microphone profile;
a hypercardoid directional microphone profile;
a supercardoid directional microphone profile;
a shotgun directional microphone profile;
a figure-8/midside directional microphone profile; or
a boundary directional microphone profile.

6. The apparatus as claimed in claim 4, wherein the apparatus is configured to define the at least one parameter field associated with the input multi-channel audio signals, the at least one parameter field configured to describe the at least one characteristic of the input multi-channel audio signals further comprising at least one third field configured to identify a characteristic associated with a specific microphone profile.

7. The apparatus as claimed in claim 6, wherein the characteristic associated with the specific microphone profile comprises at least one of:
a distance between at least two microphones of the microphone array; or
a direction of the at least one microphone of the microphone array.

8. The apparatus as claimed in claim 3, wherein the characteristic associated with the type of the input multi-channel audio signals, when the type of the input multi-channel audio signals is binaural audio signals, comprises an identified head related transfer function.

9. The apparatus as claimed in claim 8, wherein the apparatus is configured to define the at least one parameter field associated with the input multi-channel audio signals, the at least one parameter field configured to describe the at least one characteristic of the input multi-channel audio signals comprising at least one third field further configured to identify a direction associated with the head related transfer function.

10. The apparatus as claimed in claim 3, wherein the characteristic associated with the type of the input multi-channel audio signals, when the type of the input multi-channel audio signals is spatial processed audio signals, is configured to cause the apparatus to identify a parameter to determine a processing variant to assist the rendering.

11. The apparatus as claimed in claim 10, wherein the parameter for determining the processing variant to assist the rendering comprises at least one of:
a beamforming applied to at least two captured audio signals to form the input multi-channel audio signals;
a processing variant applied to the at least two captured audio signals to form the input multi-channel audio signals;
an indicator identifying possible audio rendering signal processing variants available to be selected from by a decoder;
a left-right side focus;
a front-back focus;
a noise suppressed-residual noise signal;
a target tracking-remainder signal;
a main-residual signal;
a source 1-source 2 signal; or
a beam 1-beam 2 signal.

12. The apparatus as claimed in claim 3, wherein the characteristic associated with the type of the input multi-channel audio signals, when the type of the input multi-channel audio signals is ambisonics audio signals, is configured to cause the apparatus to identify a format of the ambisonics audio signals.

13. The apparatus as claimed in claim 12, wherein the parameter identifying the format of the ambisonics audio signals comprises at least one of:
a A-format identifier;
a B-format identifier;
a four quadrants identifier; or
a head transfer function identifier.

14. The apparatus as claimed in claim 12, wherein the apparatus is configured to define the at least one parameter field, the at least one parameter field configured to describe the at least one characteristic of the input multi-channel audio signals comprising at least one third field configured to identify a normalisation associated with the ambisonics audio signals, wherein the normalisation comprises at least one of:
B-format normalisation;
SN3D normalisation;
SN2D normalisation;
maxN normalisation;
N3D normalisation; or
N2D/SN2D normalisation.

15. The apparatus as claimed in claim 1, where the apparatus is further configured to transmit the at least one parameter field associated with the input multi-channel audio signals to a renderer for rendering of the input multi-channel audio signals.

16. The apparatus as claimed in claim 1, where the apparatus is further configured to one of:
receive a user input, wherein the apparatus is configured to define the at least one parameter field associated with the input multi-channel audio signals is based on the user input; and
define the at least one parameter field associated with the input multi-channel audio signals based on the user input to cause the apparatus to define the at least one parameter field as a determined default value in the absence of the user input.

17. An apparatus comprising:

at least one processor; and at least one non-transitory memory including a computer program code, the at least one memory and the computer program code configured to, with the at least one processor, cause the apparatus at least to:

define at least one parameter field associated with multi-channel audio signals, the at least one parameter field configured to describe a characteristic of the multi-channel audio signals, wherein the at least one characteristic is configured to identify a focus amount;

determine at least one spatial audio parameter associated with the multi-channel audio signals; and control a rendering of the multi-channel audio signals with processing the multi-channel audio signals using at least the at least one characteristic of the multi-channel audio signals and the at least one spatial audio parameter.

18. The apparatus as claimed in claim 17, wherein the apparatus is further configured to:

identify a parameter to determine a processing variant to assist the rendering, wherein the focus amount is associated with the processing variant.

19. An apparatus comprising:

at least one processor; and at least one non-transitory memory including a computer program code, the at least one memory and the computer program code configured to, with the at least one processor, cause the apparatus at least to:

receive at least one parameter field associated with multi-channel audio signals, the at least one parameter field configured to describe at least one characteristic of the multi-channel audio signals, wherein the at least one characteristic is configured to identify a type of the multi-channel audio signals;

receive at least one spatial audio parameter;

determine the multi-channel audio signals; and process the multi-channel audio signals based on the at least one spatial audio parameter and the at least one parameter field associated with the multi-channel audio signals to assist a rendering of the multi-channel audio signals.

20. A method comprising:

defining at least one parameter field associated with an input multi-channel audio signals, the at least one parameter field configured to describe at least one characteristic of the input multi-channel audio signals, wherein the at least one characteristic is configured to identify a type of the input multi-channel audio signals;

determining at least one spatial audio parameter associated with the input multi-channel audio signals; and controlling a rendering of the input multi-channel audio signals with processing the input multichannel audio signals using at least the at least one characteristic of the input multi-channel audio signals and the at least one spatial audio parameter.

21. A method comprising:

receiving at least one parameter field associated with multi-channel audio signals, the at least one parameter field configured to describe at least one characteristic of the multi-channel audio signals, wherein the at least one characteristic is configured to identify a type of the multi-channel audio signals;

receiving at least one spatial audio parameter;

determining the multi-channel audio signals; and processing the multi-channel audio signals based on the at least one spatial audio parameter and the at least one parameter field associated with the multi-channel audio signals to assist a rendering of the multi-channel audio signals.

* * * * *